US006074264A

United States Patent [19]

Hattori

[11] Patent Number: 6,074,264

[45] Date of Patent: Jun. 13, 2000

[54] MANUFACTURE OF FIELD EMISSION ELEMENT WITH SHORT CIRCUIT PREVENTING FUNCTION

[75] Inventor: Atsuo Hattori, Hamamatsu, Japan

[73] Assignee: Yamaha Corporation, Japan

[21] Appl. No.: 09/290,838

[22] Filed: Apr. 13, 1999

[30] Foreign Application Priority Data

Apr. 15, 1998 [JP] Japan ..... 10-105082

[51] Int. Cl.[7] ..... H01J 9/02

[52] U.S. Cl. ..... 445/24; 445/50

[58] Field of Search ..... 445/24, 50

[56] References Cited

U.S. PATENT DOCUMENTS 5,599,749 2/1997 Hattori .
5,603,649 2/1997 Zimmerman ..... 445/24
5,720,641 2/1998 Hattori ..... 445/24
5,720,642 2/1998 Hattori ..... 445/24
5,795,208 8/1998 Hattori .
5,839,934 11/1998 Hattori ..... 445/24

*Primary Examiner*—Kenneth J. Ramsey
*Attorney, Agent, or Firm*—Osrolenk, Faber, Gerb & Soffen, LLP

[57] ABSTRACT

A method of manufacturing a field emission element includes the steps of: forming a conductive gate electrode film on a substrate; forming an insulating film on the gate electrode film; forming a hole in the insulating film and the gate electrode through etching by using a resist pattern as a mask; forming a first sacrificial film covering the insulating film and the substrate; etching back the first sacrificial film to leave a side spacer on the side wall of the hole of the gate electrode forming a second sacrificial film covering and the substrate; forming a conductive emitter electrode on the second sacrificial film; and removing a portion of the second sacrificial film to expose at least a portion of the emitter electrode film and a portion of the gate electrode film.

20 Claims, 21 Drawing Sheets

MANUFACTURE OF FIELD EMISSION ELEMENT WITH SHORT CIRCUIT PREVENTING FUNCTION

This application is based on Japanese patent application No. 10-105082 filed on Apr. 15, 1998, the entire contents of which are incorporated herein by reference.

BACKGROUND OF THE INVENTION a) Field of the Invention

The present invention relates to a method of manufacturing a field emission element, and more particularly to a method of manufacturing a field emission element which emits electrons from a tip of a field emission cathode.

b) Description of the Related Art

A field emission element is an element which emits electrons from a tip of a sharp emitter (field emission cathode) by utilizing electric field concentration. For example, a flat panel display uses a field emission emitter array (FEA) having a number of emitters. Each emitter controls the luminance and the like of a pixel of the display.

FIG. 13 illustrates an etching process of a manufacture method for a field emission element according to conventional techniques. The element shown in FIG. 13 is turned upside down from the state while each layer thereof is formed.

A method of forming each layer of this element will be described. A gate electrode layer 41 is formed on the whole surface of a starting substrate (indicated by a broken line) 40 made of silicon or the like. A resist pattern (not shown) is then formed on the gate electrode layer 41, the resist pattern being formed with a hole having a predetermined shape through photolithography.

By using this resist pattern as a mask, the gate electrode layer 41 and underlying substrate 40 are anisotropically etched to form a gate electrode 41*a* having a gate hole 48 whose plan (upper surface) shape is circular.

After the resist pattern is removed, a first sacrificial film (insulating film) is deposited and anisotropically etched to leave a partial first sacrificial film (side spacer) 42*a* indicated by a broken line. Next, a second sacrificial layer (insulating layer) 43 is isotropically deposited on the first sacrificial film 42*a* and exposed substrate 40. A portion of the second sacrificial film 43 whose diameter is narrowed by the side spacer 42*a* forms a sharp cusp. Next, a conductive emitter electrode 44 is isotropically deposited over the substrate surface.

A recess of the emitter electrode 44 is filled with a planarizing film 45, e.g., a spin-on-glass film. The planarizing film 45 is then etched back to planarize the back surface (upper surface) of the emitter electrode 44. Next, adhesive 46 made of, for example, Al, is coated on the back surface of the emitter electrode 44, and a support substrate 47 is formed on the adhesive layer 46 to enhance a mechanical strength of the element.

Thereafter, at the etching process shown in FIG. 13, the element is immersed in etching liquid 32 so that the starting substrate 40, the whole of the side spacer 42*a*, and a portion of the second sacrificial layer 43 are wet-etched isotropically to remove them, leave a second sacrificial layer 43*a*, and expose a tip of the emitter electrode (field emission cathode) 44.

With the wet etching process shown in FIG. 13, the emitter electrode 44 and gate electrode 41*a* are exposed. The distance between the emitter electrode 44 and gate electrode 41*a* is very short and 0.5 to 0.05 $\mu$m at the shortest. If particles 33 existing in or generated from the etching liquid 32 enter the gate hole 48, there is a high possibility that some particles 33 make electrical short circuits between the exposed emitter electrode 44 and gate electrode 41*a*. This phenomenon may also occur during a rinsing process and a drying process.

SUMMARY OF THE INVENTION

It is an object of the present invention to provide a method of manufacturing a field emission element capable of preventing short circuits from being formed between the exposed emitter electrode and gate electrode during manufacture processes to thereby improve manufacture yield.

According to one aspect of the present invention, a method of manufacturing a field emission element is provided which comprises the steps of: (a) forming a conductive gate electrode film on a surface of a substrate, the gate electrode film being made of at least one layer; (b) forming an insulating film on the gate electrode film; (c) forming a resist pattern on the insulating film through photolithograpy; (d) forming a hole through the insulating film through etching by using the resist pattern as a mask;(e) forming a hole in the gate electrode through etching by using the resist pattern and/or the insulating film as a mask; (f) removing the resist pattern before or after the step (e); (g) forming a first sacrificial film covering the insulating film and the substrate; (h) anisotropically etching back the first sacrificial film to leave a side spacer on a side wall of the hole of the gate electrode and/or on a side wall of the hole of the insulating film, the side spacer being made of a portion of the first sacrificial film; (i) forming a second sacrificial film covering the insulating film, the gate electrode, the side spacer, and the substrate; (j) forming a conductive emitter electrode on the second sacrificial film; and (k) removing a portion of the second sacrificial film to expose at least a portion of the emitter electrode film and a portion of the gate electrode film.

Since the insulating film is formed on the gate electrode film, particles become hard to be caught between the gate electrode film and emitter electrode film during an etching process. Even if particles are caught between the insulating film and emitter electrode film, a possibility of electrical short circuits between the gate electrode film and emitter electrode film becomes very small. Since the side space made of insulating material is left, a possibility of electrical short circuit can be reduced further.

The insulating film having the same plan shape as the gate electrode film and disposed on the gate electrode film faces the emitter electrode film. Therefore, even if particles enter the field emission element during a wet etching process, a rinsing process, or a dry process, short circuits between the gate electrode film and emitter electrode film to be caused by particles can be avoided so that element manufacture yield can be improved.

Further, the side spacer made of insulating material is left on the side wall of the gate electrode film. It is therefore possible to prevent particles from entering the space between the gate electrode film and emitter electrode film during a wet etching process, a rinsing process, or a dry process. Therefore, element manufacture yield can be improved further.

DETAILED DESCRIPTION OF THE PREFERRED EMBODIMENTS

FIGS. 1A to 10 are cross sectional views illustrating the manufacture steps of a field emission element according to the first embodiment of the invention.

Figure 1A:
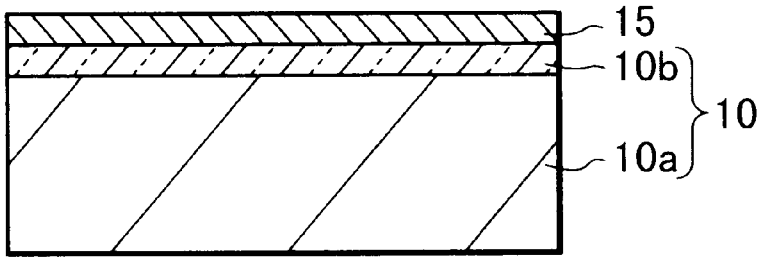
FIGS. 1A to 1O are cross sectional views illustrating manufacture processes for a field emission element (two-electrode element) according to a first embodiment of the invention.

As shown in FIG. 1A, a substrate 10 is constituted of a starting substrate 10*a* with a first laminated film 10*b* formed thereon. The starting substrate 10*a* is made of Si, for example. The starting substrate 10*a* is thermally oxidized to form on the surface of the starting substrate 10*a* a first laminated film (etching stopper film) 10*b* made of $SiO_2$ and having a thickness of 0.05 $\mu$m.

The thermal oxidation may be wet (vapor) oxidation using a vertical diffusion furnace under the conditions of a hydrogen flow rate of 19 slm, an oxygen flow rate of 19 slm and a temperature of 1000° C.

A Ti film 15 corresponding to a gate electrode (getter film) is deposited about 0.05 $\mu$m thick on the substrate 10 by sputtering. This sputtering may be performed by using a DC sputtering system while Ar gas is introduced by using Ti as a target. The gate electrode 15 may be made of metal such as Al and W, polysilicon, semiconductor such as amorphous silicon, or silicide compound such as $WSi_x$ and $TiSi_x$. In place of sputtering, chemical vapor deposition (CVD) or evaporation may be used.

Figure 1B:
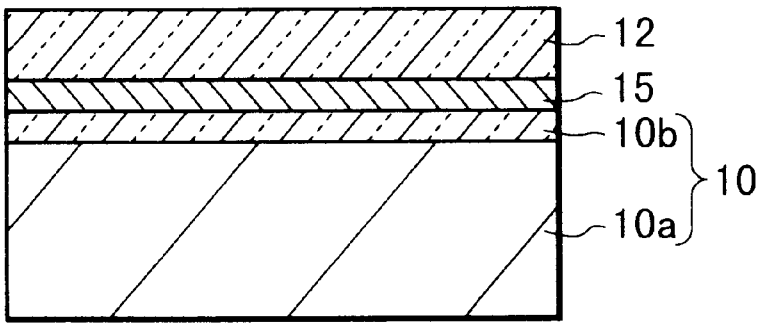

Next, as shown in FIG. 1B, a first sacrificial film (insulating film) 12 made of $SiN_x$ is deposited on the gate electrode 15 to a thickness of 0.2 $\mu$m by reactive sputtering. This reactive sputtering is performed by using a DC sputtering system while $N_2$ +Ar gas is introduced by using Si as a target. The $SiN_x$ film may be formed by plasma CVD.

Figure 1C:
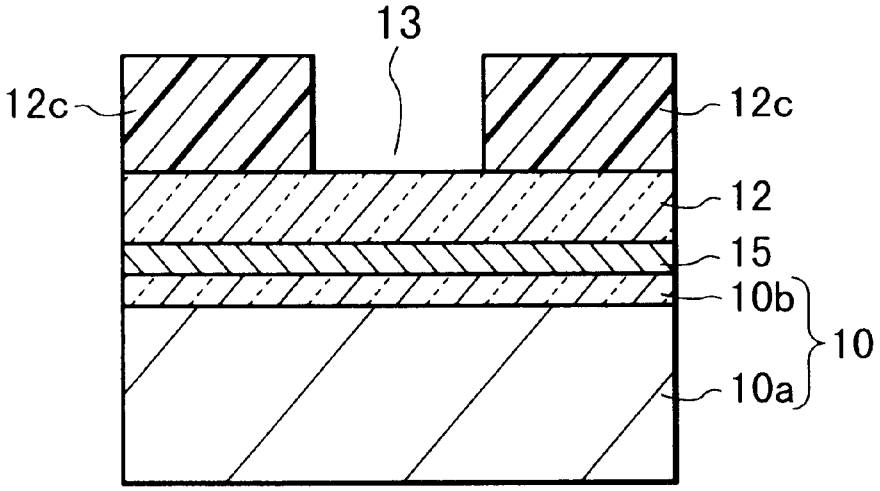

Next, as shown in FIG. 1C, a resist film 12*c* is formed on the first sacrificial film 12, the resist film 12*c* having a predetermined pattern with a hole 13 being formed through photolithography. More specifically, the resist film is coated on the whole surface of the first sacrificial film 12, and thereafter exposure and development are performed to form the resist film 12*c* having the predetermined pattern.

Figure 1D:
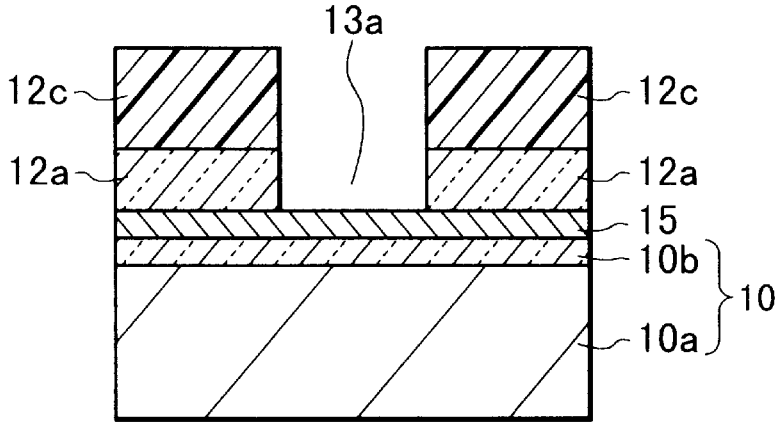

Next, by using the resist film 12*c* as a mask, the first sacrificial film 12 is anisotropically etched to leave as shown in FIG. 1D a first sacrificial film 12*a* having a predetermined pattern with a hole 13*a*. The hole 13*a* has a generally vertical side wall, a circular plan (upper surface) shape having a diameter of 0.5 $\mu$m, and a depth of about 0.2 $\mu$m. This etching may be performed by using a magnetron reactive ion etching (RIE) system and an etching gas of $CHF_3$ +$CO_2$+Ar having a flow rate ratio of $CHF_3/CO_2/Ar$=60/10/30 (sccm) under the conditions of a substrate blowing and cooling He of 8 Torr, a magnetic field of 30 G (gauss), an RF power of 700 W, and a reaction chamber pressure of 50 mTorr.

Figure 1E:
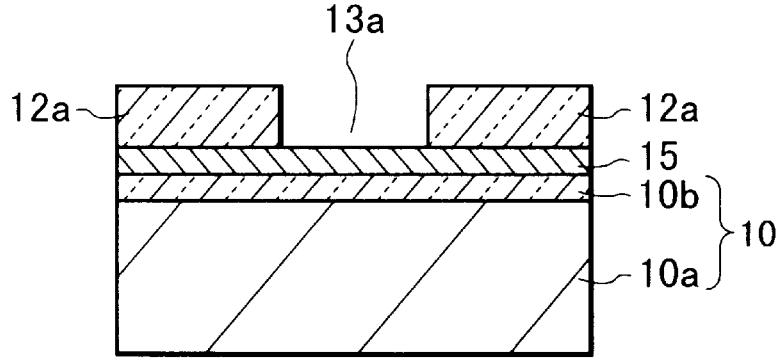

Next, as shown in FIG. 1E, the resist film 12*c* is removed to expose the upper surface of the first sacrificial film 12*a*.

Figure 1F:
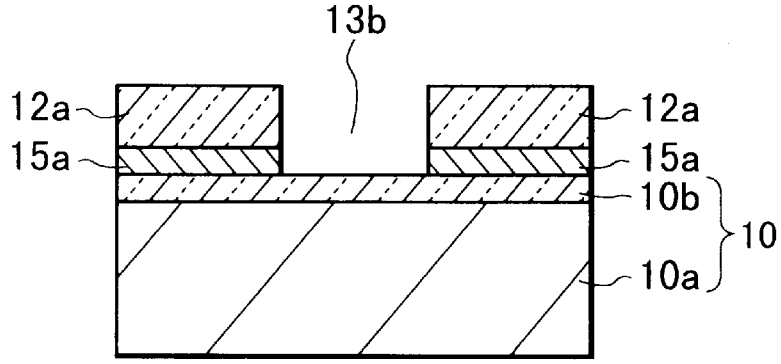

Next, as shown in FIG. 1F, by using the first sacrificial film (insulating film) 12*a* as a mask, the gate electrode 15 is anisotropically etched to form a hole 13*b* through the gate electrode 15*a*. This etching may be performed by using a magnetron RIE system and a gas of $Cl_2$ at a flow rate of 60 sccm under the conditions of a pressure of 100 mTorr, an RF power of 150 W, a magnetic field of 30 G(gauss), and a substrate blowing and cooling He of 4 Torr. The etching rate of the etching stopper film 10*b* is slower than that of the gate electrode 15.

Etching the gate electrode 15 is not limited to using only the first sacrificial film 12*a* as a mask. The first sacrificial film 12*a* and the resist film 12*c* left on the first sacrificial film 12*a* may be used as a mask to etch the gate electrode 15. In this case, the resist film 12*c* is extinguished during this etching or removed thereafter.

Figure 1G:
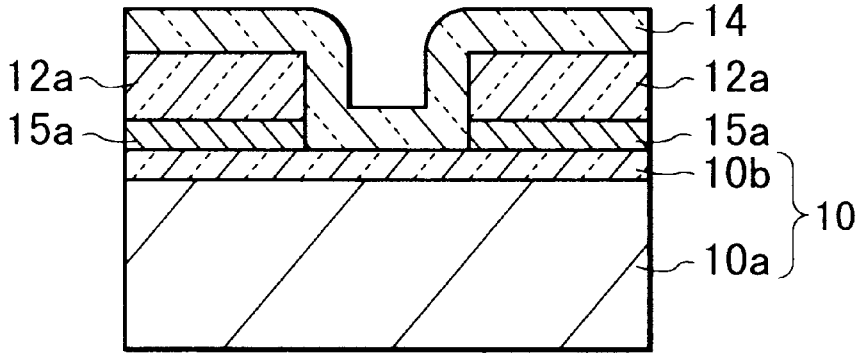

Next, as shown in FIG. 1G a second sacrificial film (insulating film) 14 of $SiO_2$ is deposited 0.15 $\mu$m thick over the whole substrate surface by atmospheric pressure CVD. This atmospheric pressure CVD may be performed at a substrate temperature of 400° C. by using $O_3$ and tetraethoxysilane (TEOS) as a source gas.

Figure 1H:
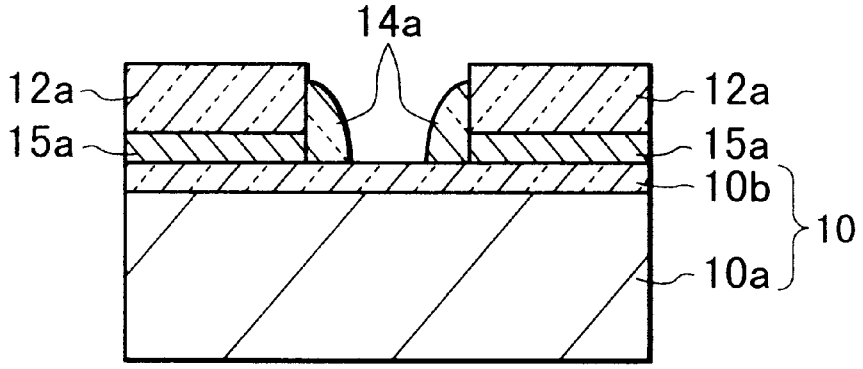

Next, as shown in FIG. 1H the second sacrificial film (insulating film) 14 is anisotropically dry-etched (etched back) to leave a portion of the second sacrificial film 14 as a side spacer 14*a* only on the side walls of the first sacrificial film 12*a* and gate electrode 10*b*. With this etching, the upper side wall of the first sacrificial film 12*a* and the surface of the first laminated film 10*b* are exposed. This etching stops at the surface of the first laminated film (etching stopper film) 10*b*. The etching may be performed by using a magnetron RIE system and $CHF_3$ +$CO_2$+Ar as etching gas under the conditions of a reaction chamber pressure of 50 mTorr and a substrate cooling He of 4 Torr.

Figure 1I:
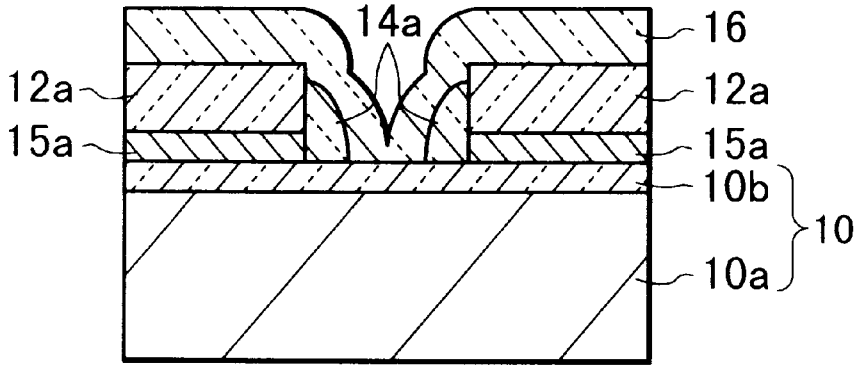

Next, as shown in FIG. 1I, a third sacrificial film (insulating film) 16 of $SiO_2$ is isotropically deposited 0.15 $\mu$m thick over the whole surface of the substrate by atmospheric pressure CVD. The film forming conditions may be a source gas of $O_3$ and TEOS and a substrate temperature of 400° C.

The third sacrificial film 16 is deposited on the surfaces of the first sacrificial film 12*a*, side spacer 14*a* and first laminated film 10*b*, inheriting the shapes of these surfaces (conformal to the surfaces). The surface shape has two-step curves in its cross section. The shape of the first step (upper) curve depends on the corner shape of the first sacrificial film 12*a*, and the shape of the second step (lower) curve depends on the surface shape of the side spacer 14*a*.

A cusp of the third sacrificial film 16 has a sharp acute angle like a cross line of two circles or ellipsoids. This acute angle area is used as a mold for forming a two-step emitter electrode as will be described hereinunder.

Figure 1J:
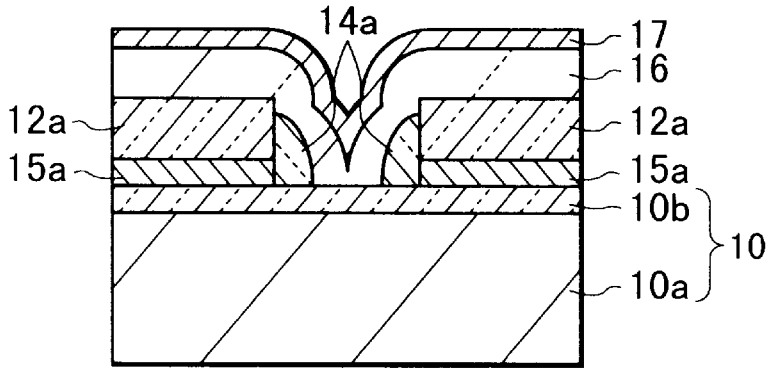

Next, as shown in FIG. 1J, an emitter electrode 17 made of, e.g., $TiN_x$ is deposited about 0.05 thick on the third sacrificial film 16 by reactive sputtering.

This reactive sputtering may be performed by using a DC sputtering system while $N_2$+Ar gas is introduced by using Ti as a target. In place of $TiN_x$, the emitter electrode 17 may be made of Mo, Cr, Ti or W.

Figure 1K:
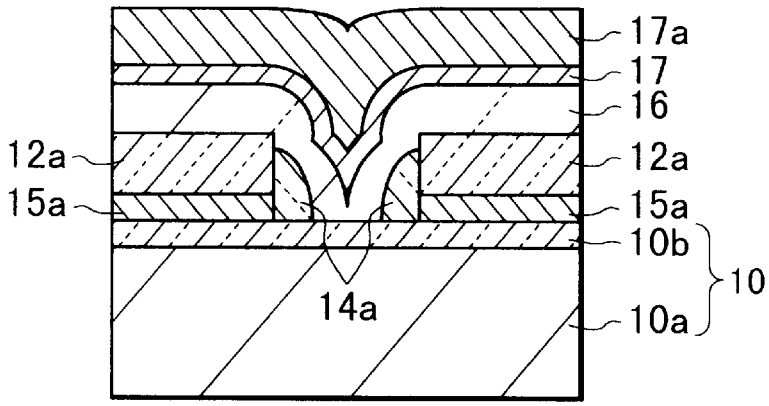

Next, as shown in FIG. 1K, a blanket film 17*a* made of W is isotropically deposited 0.2 μm thick over the whole substrate surface by CVD. This film may be formed by using $WF_6$+$H_2$+$N_2$+Ar as source gas under the conditions of a pressure of 80 Torr and a growth temperature of 450° C.

Figure 1L:
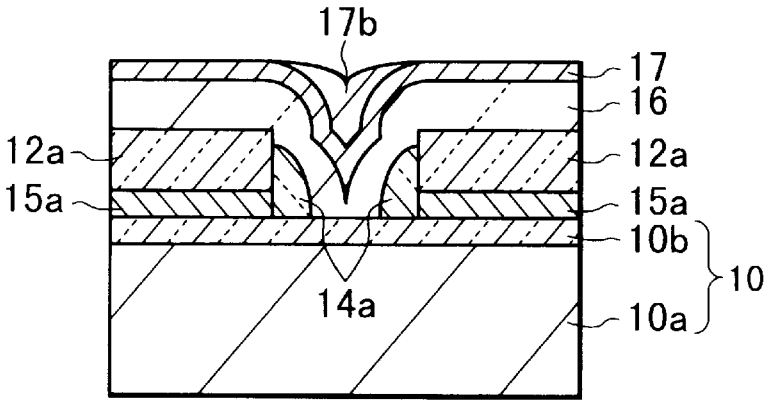

Next, as shown in FIG. 1L, the W film 17*a* is etched back 0.2 μm thick in an etcher to leave a W film 17*b* in a recess of the emitter electrode 17 and expose the upper surface of the emitter electrode 17. This etching may be performed by using a magnetron RIE system and $SF_6$+Ar+He as etching gas at a reaction chamber pressure of 280 mTorr.

Figure 1M:
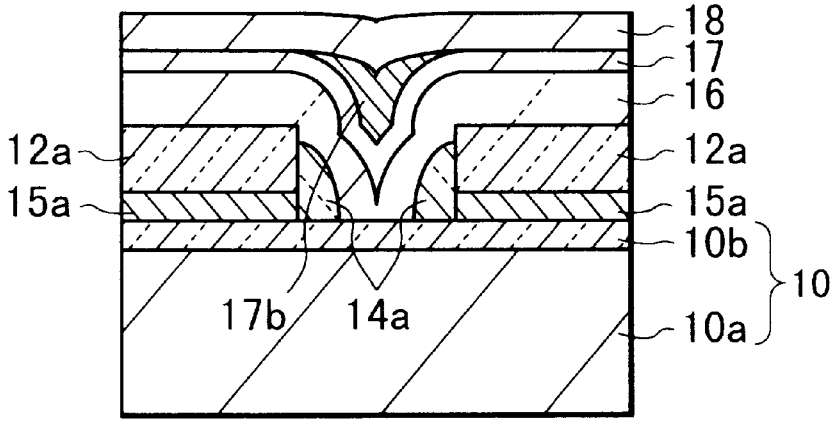

It is known that in order to sufficiently stabilize a current to be emitted from the emitter (field emission cathode), a resistor film is connected in series with the emitter electrode. To this end, as shown in FIG. 1M, a resistor film 18 of Si is deposited about 0.2 μm thick on the whole upper surface of the emitter electrode by sputtering. This sputtering is performed by using a DC sputtering system while Ar gas is introduced by using Si as a target. In place of Ar gas, $N_2$+Ar gas, $O_2$+Ar gas or $N_2$+$O_2$+Ar gas may be used for reactive sputtering in order to increase the resistance value. The resistor film 18 may be made of $SiN_x$, $SiO_x$ or $SiO_xN_Y$.

Figure 1N:
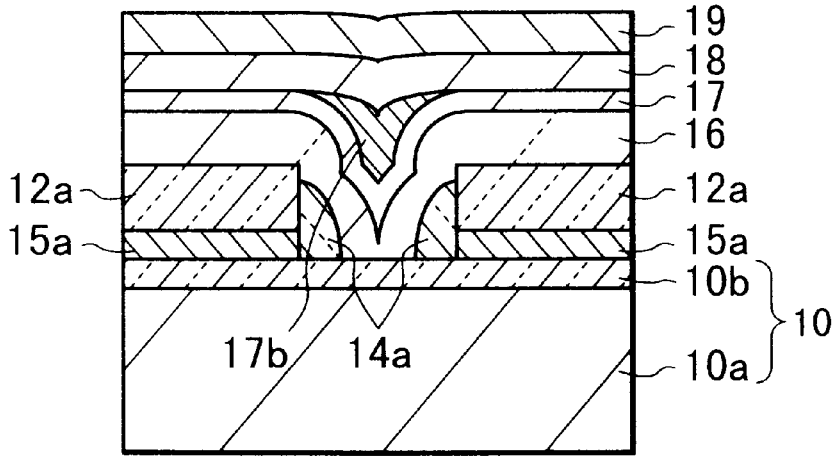
Figure 1O:
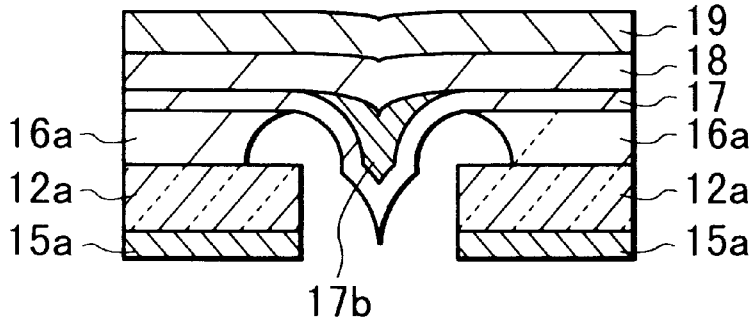

Next, as shown in FIG. 1N, an emitter wiring layer 19 is formed on the whole upper surface of the resistor film 18 by sputtering Al to a thickness of 0.5 μm. This sputtering may be performed by using a DC sputtering system while Ar gas is introduced by using Al as a target.

Figure 10:
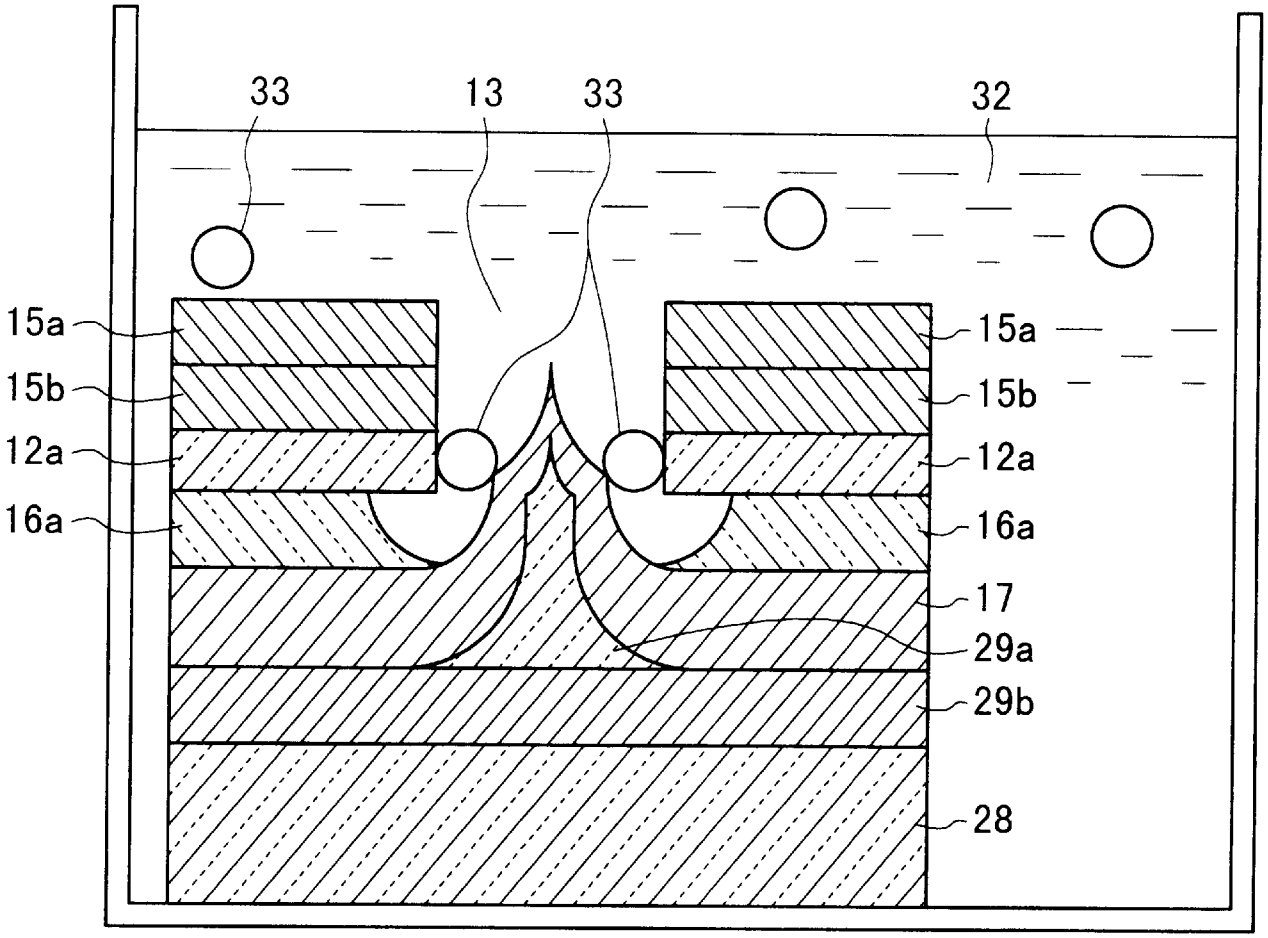
FIG. 10 is a cross sectional view illustrating the etching process to explain the effects of the field emission element manufacture method illustrated in FIG. 3C.

Lastly, as shown in FIG. 10, the substrate 10, the whole of the side spacer 14*a* and a portion of the third sacrificial film (insulating film) 16 are removed to obtain a field emission element with the exposed gate electrode 15*a* and emitter electrode 17. For etching the starting substrate 10*a* of silicon, HF+$HNO_3$+$CH_3COOH$ is used, and for etching the third sacrificial film 16 and the like of $SiO_2$, HF+$NH_4F$ is used.

An anode electrode is disposed under the gate electrode 15*a*. A positive potential is applied to the anode electrode, and a negative potential is applied to the emitter electrode. By applying a positive potential to the gate electrode 15*a*, electrons are emitted from the tip of the emitter electrode 17 toward the anode electrode.

Figure 13:
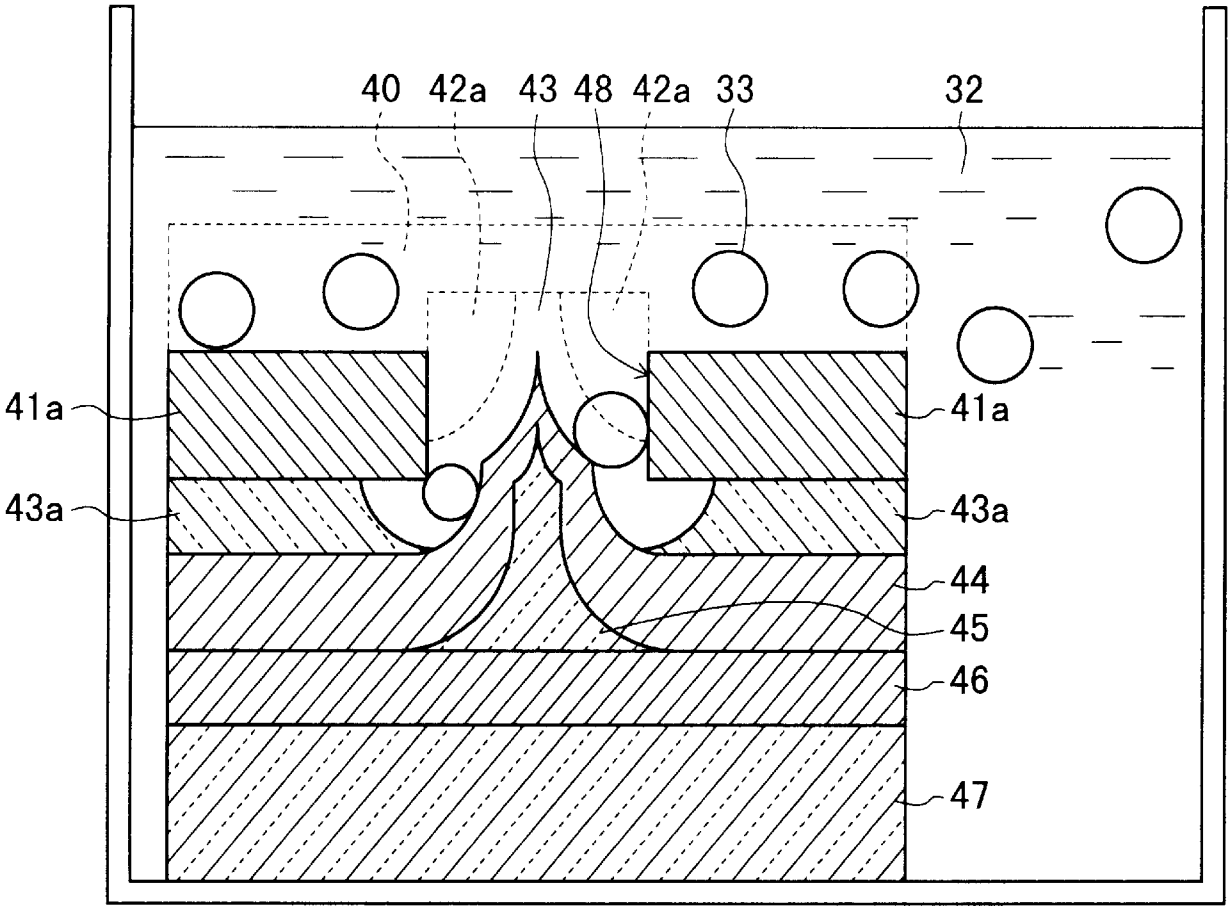
FIG.13 PRIOR ART
FIG. 13 is a cross sectional view illustrating an etching process of a field emission element manufacture method according to conventional techniques.

As described earlier with reference to FIG. 13 particles in etching liquid are likely to attach the field emission element during the etching process (FIG. 10) for the substrate 10 and the like. Although particles are likely to be caught between the emitter electrode 17 and sacrificial film (insulating film) 12, they are not likely to be caught between the emitter electrode 17 and gate electrode 15*a*. Even if particles are caught between the emitter electrode 17 and insulating film 12, short circuits are not formed between the emitter electrode 17 and gate electrode 15*a*. The details of such effects will be given later with reference to FIG. 10.

A field emission element is vacuum-sealed when the flat panel display is manufactured. The gate electrode 15*a* made of Ti also functions as a getter film. The getter film 15*a* absorbs gas near at the tip of the emitter electrode so that the vacuum degree near at the emitter electrode 17 can be improved.

Figure 2A:
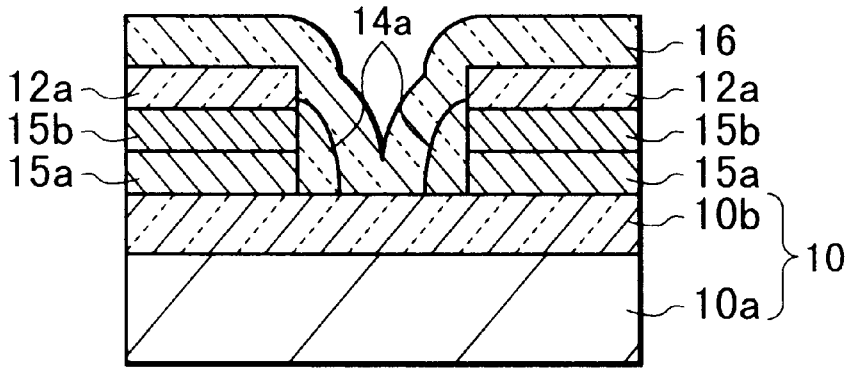
FIGS. 2A to 2C are cross sectional views illustrating manufacture processes for a field emission element (two-electrode element) according to a second embodiment of the invention.
Figure 2B:
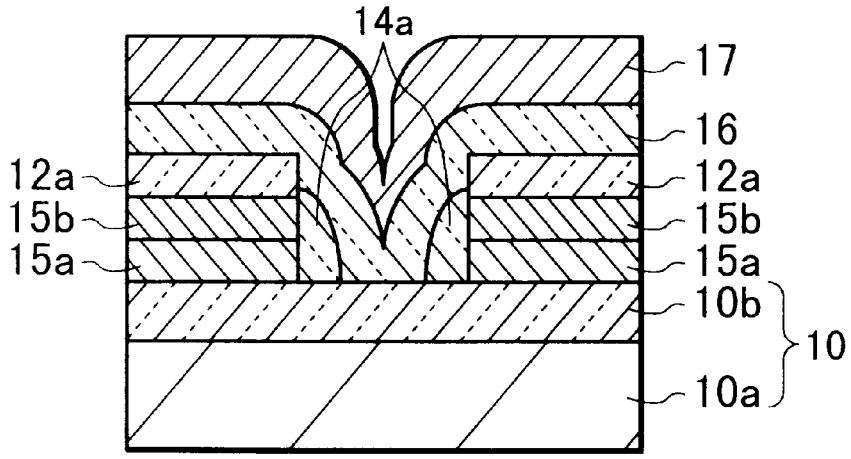
Figure 2C:
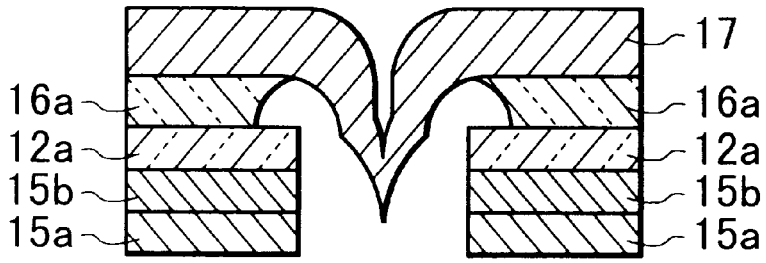

FIGS. 2A to 2C are cross sectional views illustrating the manufacture steps of a field emission element according to the second embodiment of the invention.

A substrate 10 is formed which has a starting substrate 10*a* made of Si or the like and a first laminated film (etching stopper film) 10*b* made of $SiO_2$ and formed on the starting substrate 10. On the whole surface of the substrate 10, a first gate electrode 15*a* is formed and a second gate electrode 15*b* is formed on the first gate electrode 15*a*. The first gate electrode 15*a* is made of a polysilicon film of 0.15 μm in thickness, and the second gate electrode 15*b* is made of a $WSi_x$ film of 0.15 μm in thickness.

On the whole surface of the second gate electrode 15*b*, a first sacrificial film (insulating film) 12*a* made of $SiO_xN_x$ is deposited to a thickness of 0.04 μm by reactive sputtering. This reactive sputtering is performed by using a DC sputtering system while $N_2$+$O_2$+Ar gas is introduced by using Si as a target.

The processes similar to those of the first embodiment shown in FIGS. 1C to 1I are performed. As shown in FIG. 2A, the first gate electrode 15*a*, second gate electrode 15*b* and first sacrificial film 12*a* are patterned to have a predetermined plan shape through photolithography and etching, and thereafter a side spacer 14*a* is formed only on the side walls of the first gate electrode 15*a*, second gate electrode 15*b* and first sacrificial film 12*a*. A third sacrificial film 16 is thereafter formed over the whole substrate surface.

Next, as shown in FIG. 2B, an emitter electrode 17 made of, e.g., $TiN_x$ is deposited about 0.2 μm thick on the third sacrificial film 16 by reactive sputtering. This reactive sputtering may be performed by using a DC sputtering system while $N_2$+Ar gas is introduced by using Ti as a target.

Lastly, as shown in FIG. 2C, the substrate 10, the whole of the side spacer 14*a* and a portion of the third sacrificial film (insulating film) 16 are removed to obtain a field emission element with the exposed gate electrodes 15*a* and 15*b* and emitter electrode 17. For etching the starting substrate 10*a* of silicon, HF+$HNO_3$+$CH_3COOH$ is used, and for etching the third sacrificial film 16 and the like of $SiO_2$, HF+$NH_4F$ is used.

Figure 3A:
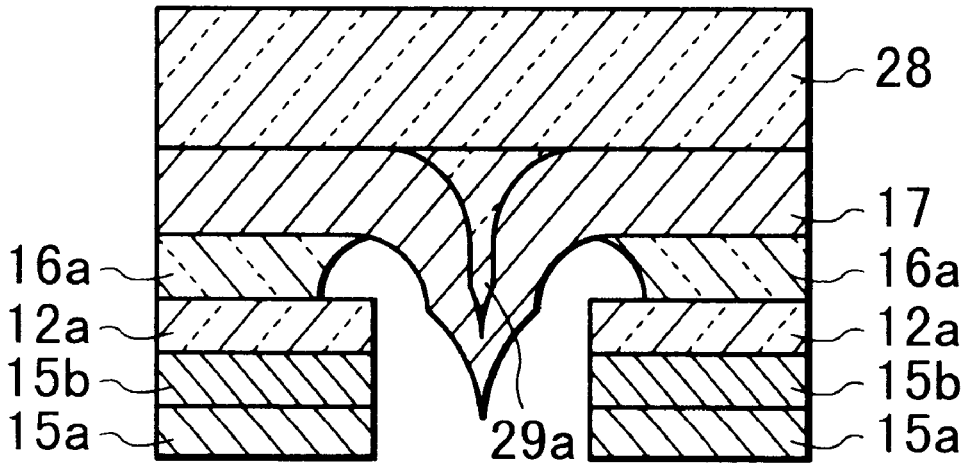
FIGS. 3A to 3D are cross sectional views illustrating four methods of reinforcing the field emission element of the second embodiment by using a support substrate.
Figure 3B:
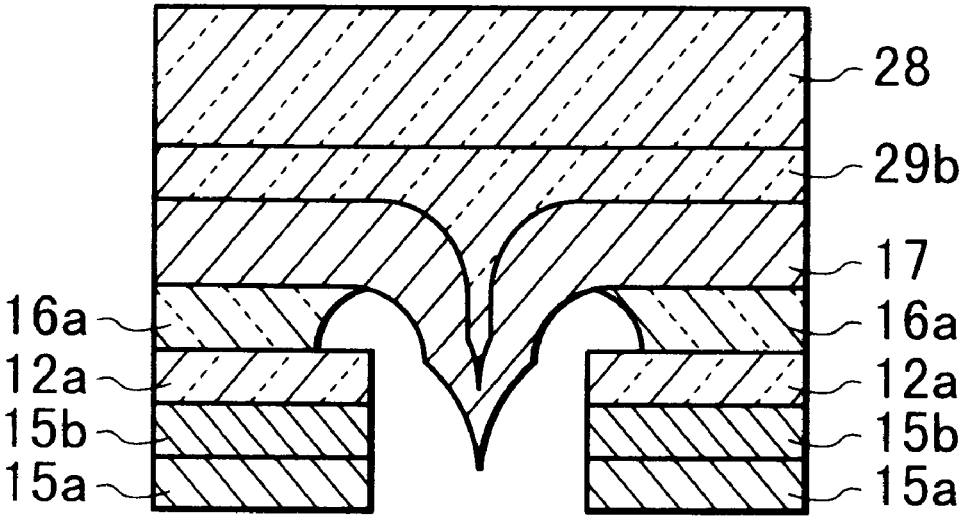
Figure 3C:
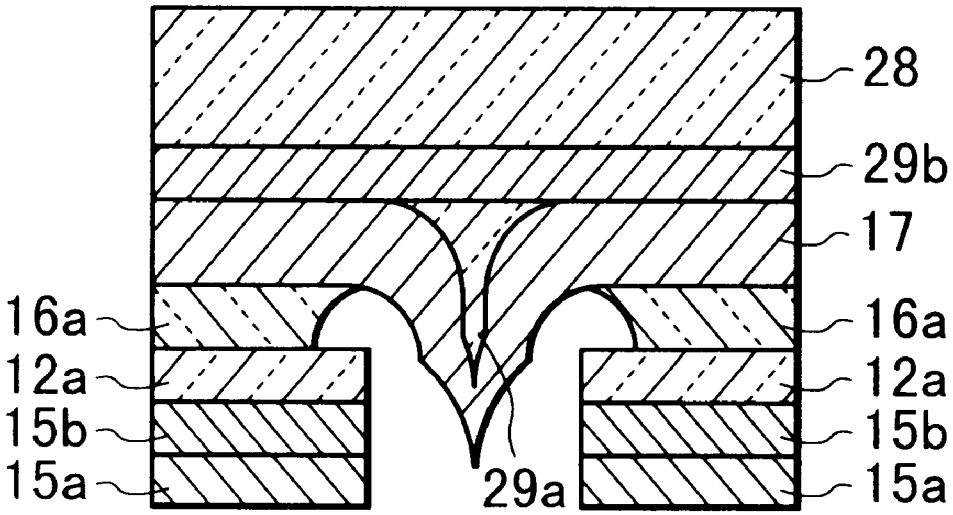

FIGS. 3A to 3C are cross sectional views illustrating four types of field emission elements whose emitter electrodes (field emission cathode) of the second embodiment are reinforced by a support substrate 17 to give a sufficient mechanical strength. In order to manufacture these four types of elements, a process is added between the process of the second embodiment shown in FIG. 2B and the etching process shown in FIG. 2C.

FIG. 3A illustrates a first method of reinforcing the emitter electrode. After the element shown in FIG. 2B is formed, a recess of the emitter electrode 17 is filled with a planarizing film 29*a* of, for example, SOG. Thereafter, the surface of the emitter electrode 17 is planarized by polishing the planarizing film 29*a* thorough chemical mechanical polishing (CMP) or by etching back the planarizing film 29*a*. Next, a support substrate 28 is adhered to the emitter electrode 17 and planarizing film 29*a* through electrostatic bonding or with adhesive. The support substrate 28 is made of, for example, glass, quartz, or $Al_2O_3$.

Thereafter, the process similar to the etching process of FIG. 2C is performed to remove the substrate 10*a* and the like to expose the tip of the emitter electrode (field emission cathode) 17 as shown in FIG. 3A.

FIG. 3B illustrates the second method. After the element shown in FIG. 2B is formed, adhesive 29*b* such as low melting point glass is reflowed on the emitter electrode 17 to adhere the emitter electrode 17 and a support substrate 28 together. The adhesive 29*b* also functions to planarize the surface of the emitter electrode 15.

Instead of the low melting point glass, Al may be used as the adhesive 29*b*. In this case, the emitter electrode 17 and support substrate 28 may be adhered together by anodic bonding using electrostatic forces generated upon application of a high voltage of 1 kV between the support substrate 28 and adhesive 29*b* (or emitter electrode 17) and maintaining the temperature at 400 to 500° C. If Al is used as the adhesive 29*a*, this Al layer 29*b* may be used as an emitter wiring. Thereafter, the process similar to the etching process of FIG. 2C is performed to remove the substrate 10 and the like to expose the tip of the emitter electrode (field emission cathode) 17 as shown in FIG. 3B.

FIG. 3C illustrates the third method. After the element shown in FIG. 2B is formed, the recess of the emitter electrode 17 is filled with a planarizing film 29*a* made of, for example, SOG. Thereafter, the planarizing film 29*a* is etched back to planarize the surface of the emitter electrode 17. A support substrate 28 is adhered to the emitter electrode 17 by using adhesive 29*b* such as Al. Thereafter, the process similar to that shown in FIG. 2C is performed to remove the substrate 10 and the like and expose the tip of the emitter electrode 17 as shown in FIG. 3C.

Figure 3D:
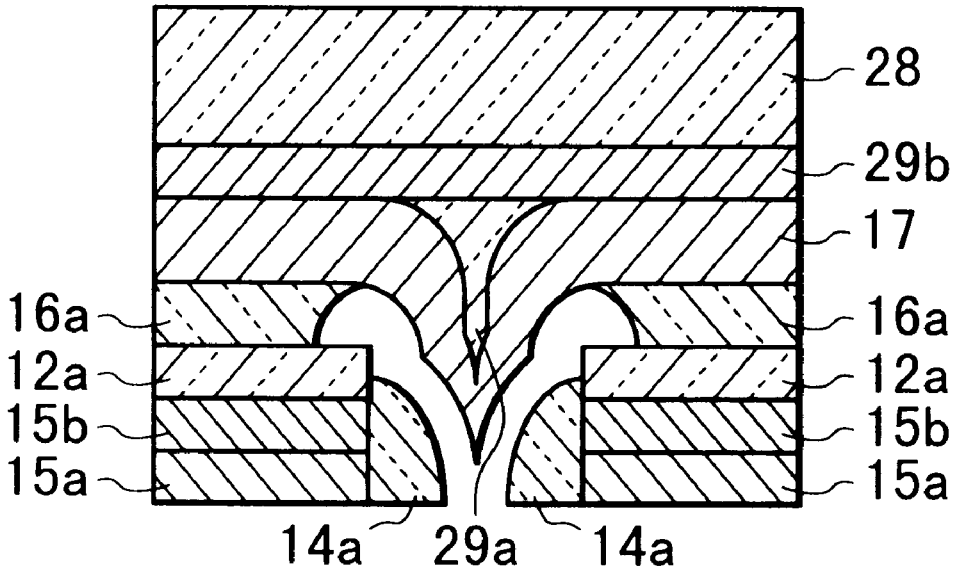

FIG. 3D illustrates the fourth method. Similar to the process shown in FIG. 3C, the emitter electrode 17 and support substrate 28 are adhered together by adhesive 29*b*. Thereafter, similar to the process shown in FIG. 2C, the substrate 10 and a portion of the third sacrificial film 16 are wet etched to leave a side spacer 14*a* as shown in FIG. 3D. For example, if the side space 14*a* is made of $SiN_x$, $SiO_xN_y$ or the like formed by low pressure CVD or plasma CVD, the side spacer 14*a* is not etched with $HF+NH_4F$. The tip of the emitter 17 is therefore exposed.

The left side spacer 14*a* prevents particles from entering the gate hole during the etching process and also prevents particles from being caught between the emitter electrode 17 and gate electrodes 15*a* and 15*b*. The details of these effects will be later given with reference to FIG. 11.

Figure 4A:
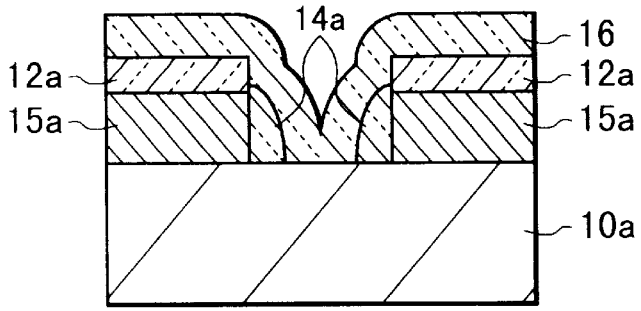
FIGS. 4A to 4D are cross sectional views illustrating manufacture processes for a field emission element (two-electrode element) according to a third embodiment of the invention.
Figure 4B:
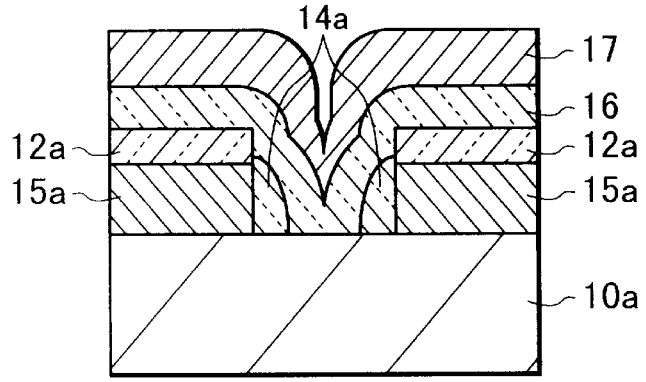
Figure 4C:
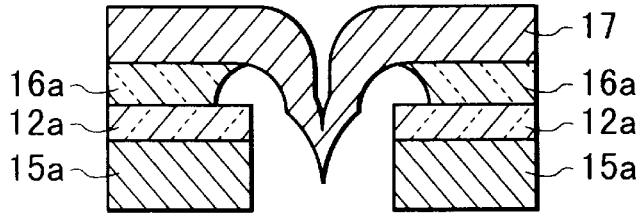

FIGS. 4A to 4C are cross sectional views illustrating the manufacture steps of a field emission element (two-electrode element) according to the third embodiment of the invention.

As shown in FIG. 4A, on the surface of a starting substrate 10*a* made of Si, a gate electrode 15 made of $AlSi_xCu_y$ alloy is formed to a thickness of 0.3 $\mu$m by sputtering. For example, this sputtering is performed by using a DC sputtering system while Ar gas is introduced by using $AlSi_xCu_y$ as a target.

Next, on the surface of the gate electrode 15, a first sacrificial film (insulating film) 12 made of an $SiN_x$ film is deposited to a thickness of 0.05 $\mu$m by reactive sputtering. For example, this sputtering is performed by using a DC sputtering system while $N_2$+Ar gas is introduced by using Si as a target.

The processes similar to those of the first embodiment shown in FIGS. 1C to 1I are performed. As shown in FIG. 4A, the gate electrode 15*a* and first sacrificial film 12*a* are patterned to have a predetermined plan shape, and thereafter a side spacer 14*a* is formed only on the side walls of the gate electrode 15*a* and first sacrificial film 12*a*. A third sacrificial film 16 is thereafter formed over the whole substrate surface.

Next, as shown in FIG. 4B, an emitter electrode 17 made of, e.g., $TiN_x$ is deposited about 0.2 $\mu$m thick on the third sacrificial film 16 by reactive sputtering. This reactive sputtering may be performed by using a DC sputtering system while $N_2$+Ar gas is introduced by using Ti as a target.

Lastly, as shown in FIG. 4C, the starting substrate 10*a*, the whole of the side spacer 14*a* and a portion of the third sacrificial film (insulating film) 16 are removed to obtain a field emission element of the two-electrode structure with the exposed gate electrode 15*a* and emitter electrode 17. For etching the starting substrate 10*a* of silicon, $HF+HNO_3+CH_3COOH$ is used, and for etching the third sacrificial film 16 and the like of $SiO_2$, $HF+NH_4F$ is used.

Figure 4D:
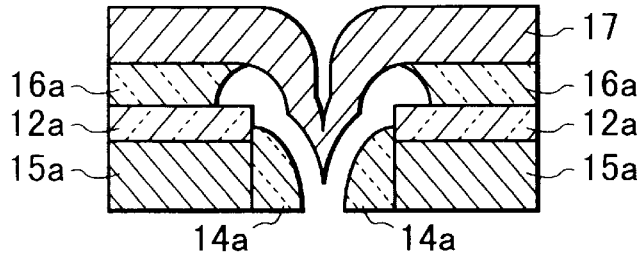

As shown in FIG. 4D, a side spacer 14*a* may be formed, the side spacer 14*a* being made of $SiN_x$, $SiO_xN_y$ or the like through low pressure CVD or plasma CVD.

Figure 5A:
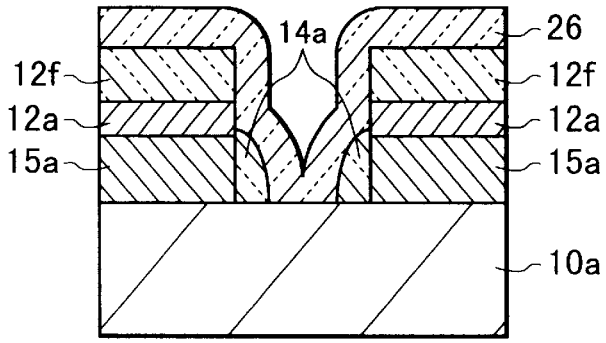
FIGS. 5A to 5D are cross sectional views illustrating manufacture processes for a field emission element (two-electrode element) according to a fourth embodiment of the invention.
Figure 5B:
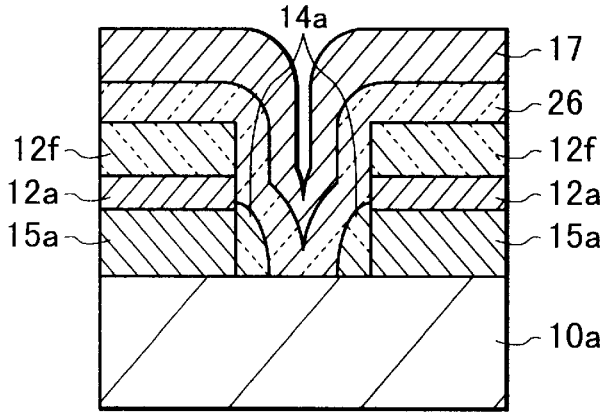
Figure 5C:
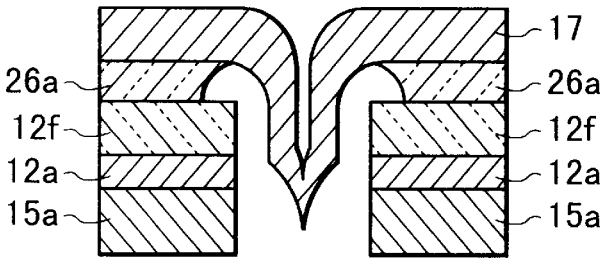

FIGS. 5A to 5C are cross sectional views illustrating the manufacture steps of a field emission element (two-electrode element) according to the fourth embodiment of the invention.

As shown in FIG. 5A, similar to the processes described earlier, on the surface of a starting substrate 10*a* made of Si, a first gate electrode 15*a*, a first sacrificial film 12*a* and a second sacrificial film (insulating film) 12*f* respectively having a predetermined pattern are formed through photolithography and etching.

More specifically, on the surface of a starting substrate 10*a* made of Si, a first gate electrode of $WSi_x$ is deposited 0.3 $\mu$m thick by CVD, on the surface of the first gate electrode, a first sacrificial film of $TiN_x$ is deposited 0.04 $\mu$m thick by reactive sputtering, and on the surface of the first sacrificial film, a second sacrificial film of $SiN_x$ is deposited 0.15 $\mu$m thick by reactive sputtering. Thereafter, by photolithograpy and etching, the first gate electrode, first sacrificial film and second sacrificial film are patterned to form the first gate electrode 15*a* and first and second sacrificial films 12*a* and 12*f*.

Sputtering for the first sacrificial film ($TiN_x$) may be performed by using a DC sputtering system while $N_2$+Ar gas is introduced by using Ti as a target. Sputtering for the second sacrificial film ($SiN_x$) may be performed by using a DC sputtering system while $N_2$+Ar gas is introduced by using Si as a target. Instead of sputtering, the second sacrificial film ($SiN_x$) may be deposited by low pressure CVD or plasma CVD.

The processes similar to those of the first embodiment shown in FIGS. 1C to 1I are performed. As shown in FIG. 5A, a side spacer 14*a* is formed only on the side walls of the gate electrode 15*a* and first sacrificial film 12*a*, and a fourth sacrificial film (insulating film) 26 of $SiO_2$ is isotropically deposited over the whole substrate surface to a thickness of 0.15 $\mu$m. The fourth sacrificial film 26 is deposited on the surfaces of the substrate 10*a*, side spacer 14*a*, first and second sacrificial films 12*a* and 12*f*, inheriting the shapes of these surfaces. The surface shape has two-step curves in its cross section. This surface shape is used as a mold for forming a two-step emitter electrode as will be described hereinunder.

Next, as shown in FIG. 5B, an emitter electrode 17 made of, e.g., $TiN_x$ is deposited about 0.2 μm thick on the fourth sacrificial film 26 by reactive sputtering.

Next, as shown in FIG. 5C, the substrate 10*a*, the whole of the side spacer 14*a* and a portion of the fourth sacrificial film 26 are etched and removed to leave a fourth sacrificial film 26*a* and expose the tip of the emitter electrode 17. The first sacrificial film 12*a* functions as a second gate electrode.

Figure 5D:
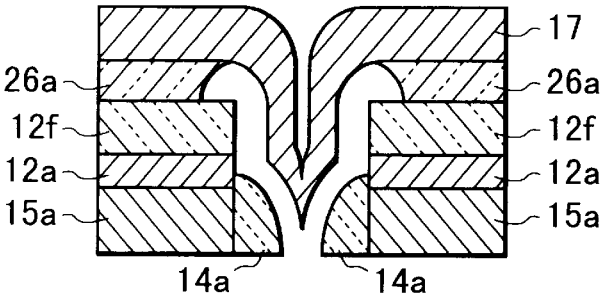

As shown in FIG. 5D, a side spacer 14*a* may be formed, the side spacer 14*a* being made of $SiN_x$, $SiO_xN_y$ or the like through low pressure CVD or plasma CVD.

FIGS. 6A to 6D are cross sectional views illustrating the manufacture steps of a field emission element (two-electrode element) according to the fifth embodiment of the invention.

Figure 6A:
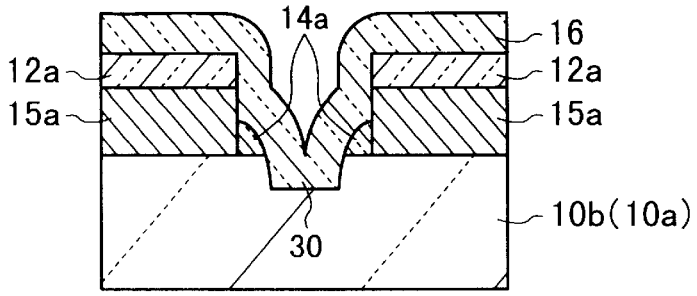
FIGS. 6A to 6D are cross sectional views illustrating manufacture processes for a field emission element (two-electrode element) according to a fifth embodiment of the invention.

As shown in FIG. 6A, similar to the processes described earlier, on the surface of a starting substrate 10*a* made of quartz or glass, a gate electrode 15*a* and a first sacrificial film (insulating film) 12*a* respectively having a predetermined pattern are formed through photolithography and etching.

More specifically, on the surface of a starting substrate 10*a* made of quartz Si, a gate electrode of polysilicon doped with P or B is deposited 0.15 μm thick by CVD, and on the surface of the gate electrode, a first sacrificial film of $SiN_x$ is deposited 0.04 μm thick by reactive sputtering. Thereafter, by photolithograpy and etching, the gate electrode and first sacrificial film are patterned to form the gate electrode 15*a* and first sacrificial films 12*a*.

Sputtering for the first sacrificial film ($SiN_x$) may be performed by using a DC sputtering system while $N_2$+Ar gas is introduced by using Si as a target. Instead of sputtering, the first sacrificial film may be deposited by low pressure CVD or plasma CVD.

The processes similar to those of the first embodiment shown in FIGS. 1C to 1I are performed. Namely, a second sacrificial film (insulating film) of $SiO_2$ is deposited 0.15 μm over the whole substrate surface by atmospheric pressure CVD. Next, the second sacrificial film is anisotropically dry-etched to leave a second sacrificial film 14*a* as a side spacer only on the side wall of the gate electrode 15*a*. This dry etching is stopped when the side wall of the first sacrificial film 12*a* is exposed, the upper side wall of the gate electrode 15*a* is exposed, and the substrate 10*a* is etched to a depth of 0.1 μm. This etching forms a substrate 10*b* having a recess 30.

Next, a third sacrificial film (insulating film) 16 of $SiO_2$ is isotropically deposited over the whole substrate surface to a thickness of 0.15 μm by atmospheric pressure CVD. The third sacrificial film 16 is deposited on the surfaces of the substrate 10*b*, side spacer 14*a*, gate electrode 15*a* and first sacrificial film 12*a*, inheriting the shapes of these surfaces. The surface shape has two-step curves in its cross section. This surface shape is used as a mold for forming a two-step emitter electrode as will be described hereinunder.

Figure 6B:
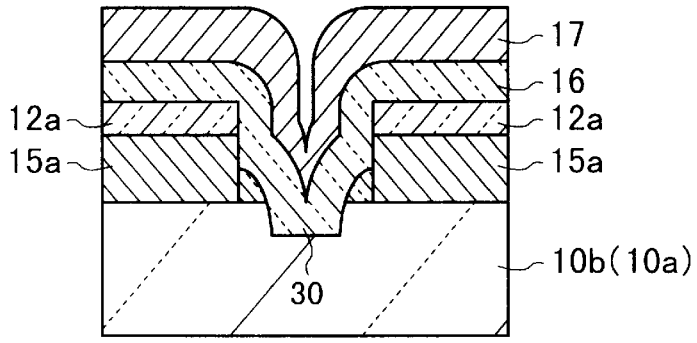

Next, as shown in FIG. 6B, an emitter electrode 17 made of, e.g., $TiN_x$ is deposited about 0.2 μm thick on the third sacrificial film 16 by reactive sputtering. This reactive sputtering may be performed by using a DC sputtering system while $N_2$+Ar gas is introduced by using Ti as a target.

Figure 6C:
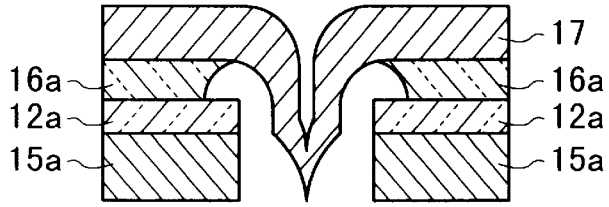

Lastly, as shown in FIG. 6C, the substrate 10*b*, the whole of the side spacer 14*a* and a portion of the third sacrificial film 16 are etched and removed to leave a peripheral third sacrificial film 16*a* and expose the tip of the emitter electrode 17.

Figure 6D:
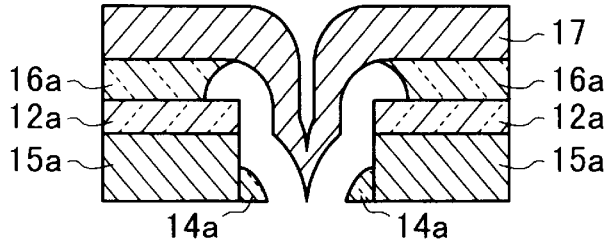

As shown in FIG. 6D, a side spacer 14*a* may be formed, the side spacer 14*a* being made of $SiN_x$, $SiO_xN_y$ or the like through low pressure CVD or plasma CVD.

The two-electrode element shown in FIGS. 6C and 6D has the recess 30 formed on the substrate 10*b*. Therefore, as compared to the two-electrode element shown in FIGS. 5C and 5D, the position of the emitter electrode 17 relative to the gate electrode 15*a* can be lowered.

Figure 7A:
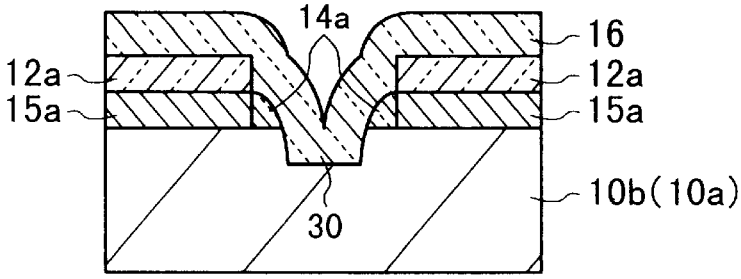
FIGS. 7A to 7D are cross sectional views illustrating manufacture processes for a field emission element (two-electrode element) according to a sixth embodiment of the invention.
Figure 7B:
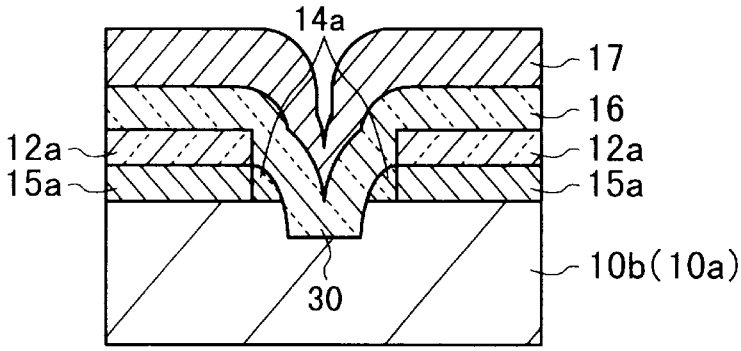
Figure 7C:
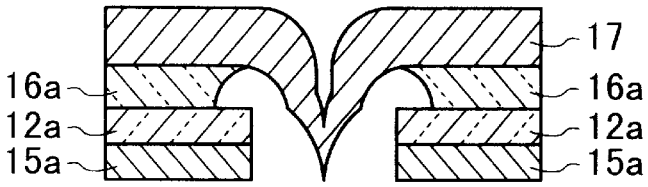

FIGS. 7A to 7C are cross sectional views illustrating the manufacture steps of a field emission element (two-electrode element) according to the sixth embodiment of the invention.

As shown in FIG. 7A, similar to the processes described earlier, on the surface of a starting substrate 10*a* made of Si, a gate electrode (getter film) 15*a* and a first sacrificial film (insulating film) 12*a* respectively having a predetermined pattern are formed through photolithography and etching.

More specifically, on the surface of the starting substrate 10*a* made of Si, a first gate electrode of Ti is deposited 0.1 μm thick by sputtering, and on the surface of the gate electrode, a first sacrificial film of $SiN_x$ is deposited 0.04 μm thick by reactive sputtering. Thereafter, by photolithograpy and etching, the first gate electrode and first sacrificial film are patterned to form the gate electrode 15*a* and first sacrificial film 12*a*.

Sputtering for the first sacrificial film ($SiN_x$) may be performed by using a DC sputtering system while $N_2$+Ar gas is introduced by using Si as a target. Instead of sputtering, the first sacrificial film may be deposited by low pressure CVD or plasma CVD.

The processes similar to those of the first embodiment shown in FIGS. 1C to 1I are performed. Namely, a second sacrificial film (insulating film) of $SiO_2$ is deposited 0.15 μm over the whole substrate surface by atmospheric pressure CVD. Next, the second sacrificial film is anisotropically dry-etched to leave a second sacrificial film 14*a* as a side spacer only on the side wall of the gate electrode 15*a*. This dry etching is stopped when the side wall of the first sacrificial film 12*a* is exposed and the substrate 10*a* is etched to a depth of 0.1 μm. This etching forms a substrate 10*b* having a recess 30.

Next, a third sacrificial film (insulating film) 16 of $SiO_2$ is isotropically deposited over the whole substrate surface to a thickness of 0.15 μm by atmospheric pressure CVD. The third sacrificial film 16 is deposited on the surfaces of the substrate 10*b*, side spacer 14*a* and first sacrificial film 12*a*, inheriting the shapes of these surfaces. The surface shape has two-step curves in its cross section. This surface shape is used as a mold for forming a two-step emitter electrode as will be described hereinunder.

Next, as shown in FIG. 7B, an emitter electrode 17 made of, e.g., $TiN_x$ is deposited about 0.2 μm thick on the third sacrificial film 16 by reactive sputtering. This reactive sputtering may be performed by using a DC sputtering system while $N_2$+Ar gas is introduced by using Ti as a target.

Lastly, as shown in FIG. 7C, the substrate 10*b*, the whole of the side spacer 14*a* and a portion of the third sacrificial film 16 are etched and removed to leave a peripheral third sacrificial film 16*a* and expose the tip of the emitter electrode 17.

Figure 7D:
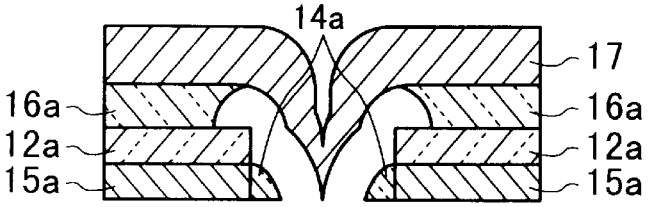

As shown in FIG. 7D, a side spacer 14*a* may be formed, the side spacer 14*a* being made of $SiN_x$, $SiO_xN_y$ or the like through low pressure CVD or plasma CVD.

The gate electrode 15*a* made of Ti also functions as a getter film. The getter film 15*a* absorbs nearby gas so that the vacuum degree near at the tip of the emitter electrode 17 is improved.

The methods of manufacturing a field emission element (two-electrode element) have been described above. Next, a method of manufacturing another type of a field emission element having a three-electrode structure will be described.

FIGS. 8A to 8L are cross sectional views illustrating the manufacture steps of a field emission element (three-electrode element) according to the seventh embodiment of the invention.

Figure 8A:
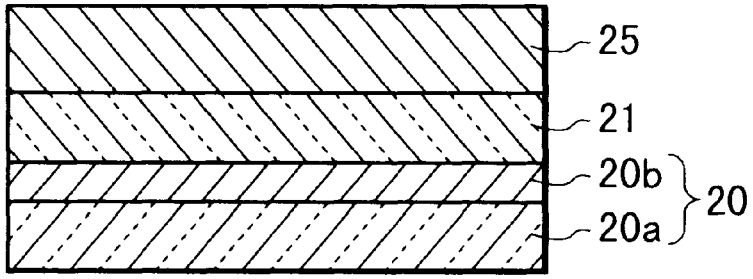
FIGS. 8A to 8L are cross sectional views illustrating manufacture processes for a field emission element (two-electrode element) according to a seventh embodiment of the invention.

As shown in FIG. 8A, a substrate 20 is constituted of a starting substrate 20*a* made of quartz, glass or the like and an anode electrode 20*b* made of AlSiCu. The anode electrode 20*b* is formed by sputtering and has a thickness of 0.3 μm. Sputtering for the anode electrode ($AlSi_xCu_y$) 20 may be performed by using a DC sputtering system while Ar gas is introduced by using $AlSi_xCu_y$ as a target.

Next, a first sacrificial film (insulating film) 21 of $SiO_2$ is deposited on the anode electrode 20*b* by CVD. On the first sacrificial film 21, a gate electrode 25 of $AlSi_xCu_y$ is deposited by sputtering similar to the anode electrode 20*b*.

Figure 8B:
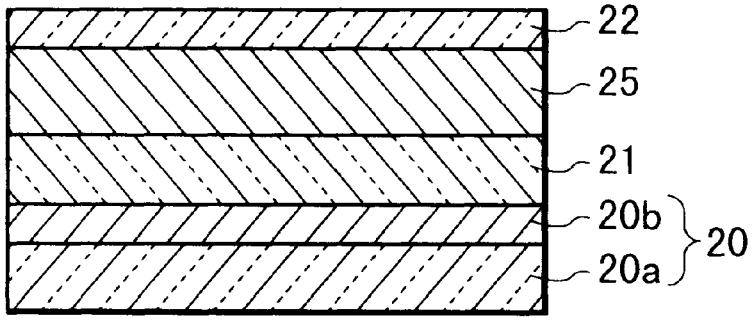

Next, as shown in FIG. 8B, a second sacrificial film (insulating film) 22 made of $SiN_x$ is deposited on the gate electrode 25 to a thickness of 0.04 μm by reactive sputtering. Sputtering for the second sacrificial film ($SiN_x$) 22 is performed by using a DC sputtering system while $N_2$+Ar gas is introduced by using Si as a target.

Figure 8C:
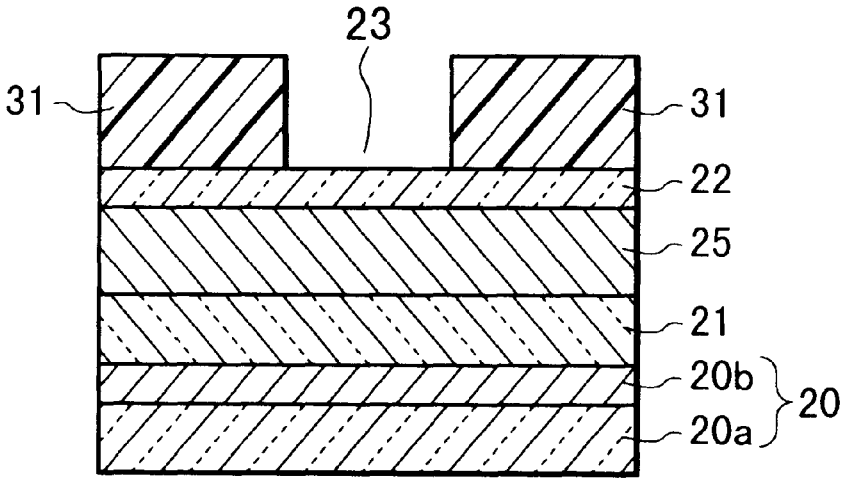

Next, as shown in FIG. 8C, a resist film 31 is formed on the second sacrificial film 22, the resist film 31 having a predetermined pattern with a hole 23 being formed through photolithography.

Figure 8D:
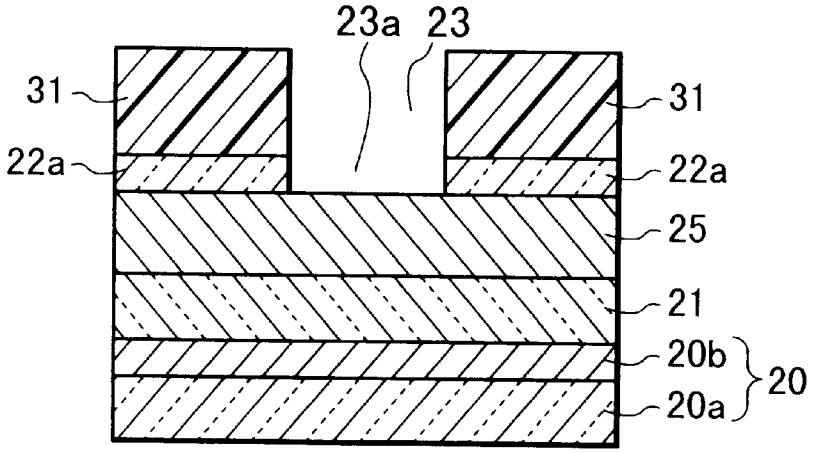

Next, as shown in FIG. 8D, by using the resist film 31 as a mask, the second sacrificial film 22 is anisotropically etched to leave a second sacrificial film 22*a* having a predetermined pattern with a hole 23*a*. The hole 23*a* has a circular plan (upper surface) shape having a diameter of 0.5 μm.

Figure 8E:
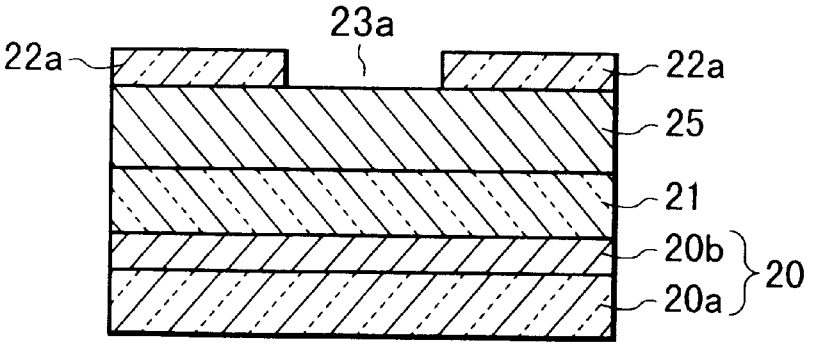

Next, as shown in FIG. 8E, the resist film 31 is removed to expose the upper surface of the second sacrificial film 22*a*.

Figure 8F:
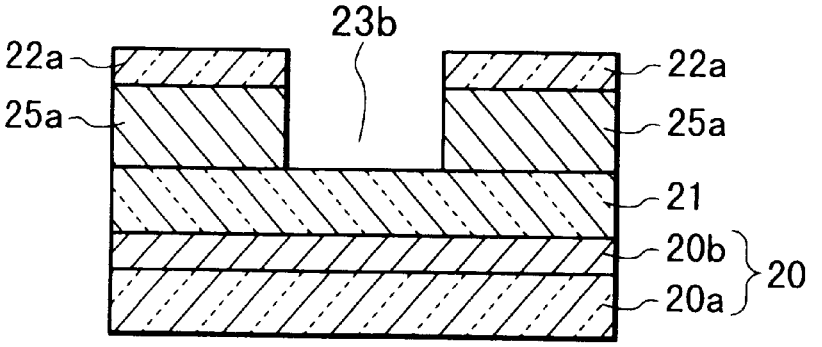

Next, as shown in FIG. 8F, by using the second sacrificial film 22*a* as a mask, the gate electrode 25 is anisotropically etched to leave a gate electrode 25*a* having a predetermined pattern with a hole 23*b*.

In etching the gate electrode 25, the second sacrificial film 22*a* and the resist film 31 left on the second sacrificial film 22*a* may be used as a mask. The resist film 31 is removed thereafter.

Figure 8G:
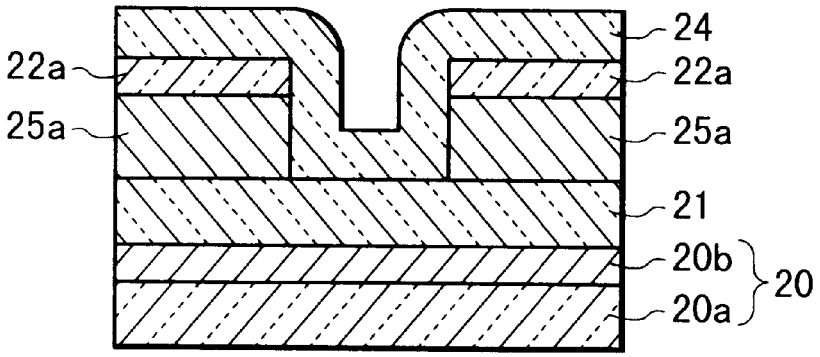

Next, as shown in FIG. 8G a third sacrificial film (insulating film) 24 of $SiO_2$ is deposited 0.15 μm thick over the whole substrate surface by atmospheric pressure CVD. This atmospheric pressure CVD may be performed at a substrate temperature of 400° C. by using $O_3$ and TEOS as a source gas.

Figure 8H:
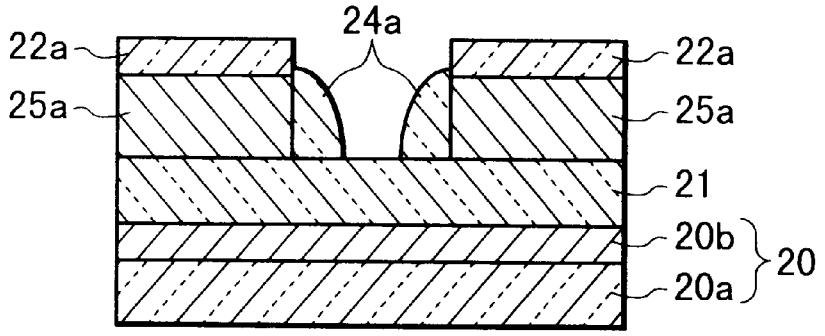

Next, as shown in FIG. 8H the third sacrificial film (insulating film) 24 is anisotropically dry-etched (etched back) to leave a portion of the third sacrificial film 24*a* as a side spacer on the side walls of the gate electrode 25*a* and/or second sacrificial film 22*a*. With this etching, the upper side wall of the second sacrificial film 22*a* and the surface of the first laminated film 21 are exposed.

Anisotropical dry etching is used for this etch-back. For example, a magnetron RIE system is used and $CHF_3$+$CO_2$+Ar is used as etching gas under the conditions of a reaction chamber pressure of 50 mTorr, a flow rate ratio of $CHF_3$/$CO_2$/Ar=60/10/30 (sccm), a substrate cooling He of 8 Torr, a magnetic field of 30 G (gauss), and an RF power of 700 W.

Figure 8I:
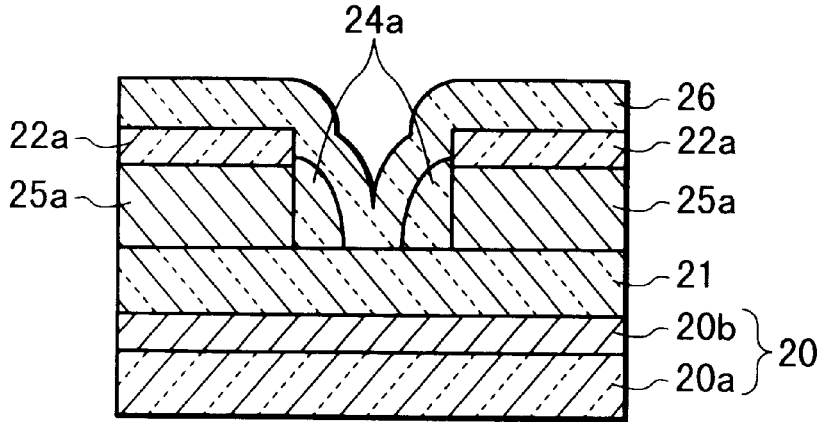

Next, as shown in FIG. 8I, a fourth sacrificial film (insulating film) 26 of $SiO_2$ is isotropically deposited 0.15 μm over the whole surface of the substrate by atmospheric pressure CVD. The fourth sacrificial film 26 is deposited on the surfaces of the first sacrificial film 21, side spacer 24*a* and second sacrificial film 22*a*, inheriting the shapes of these surfaces. The surface shape has two-step curves in its cross section. This surface shape is used as a mold for forming a two-step emitter electrode as will be described hereinunder.

Figure 8J:
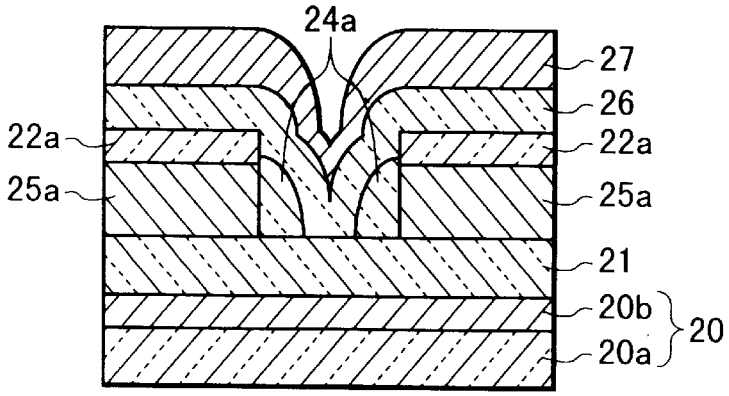

Next, as shown in FIG. 8J, an emitter electrode 27 made of, e.g., $TiN_x$ is deposited about 0.2 μm thick on the fourth sacrificial film 26 by reactive sputtering. This reactive sputtering may be performed by using a DC sputtering system while $N_2$+Ar gas is introduced by using Ti as a target.

Figure 8K:
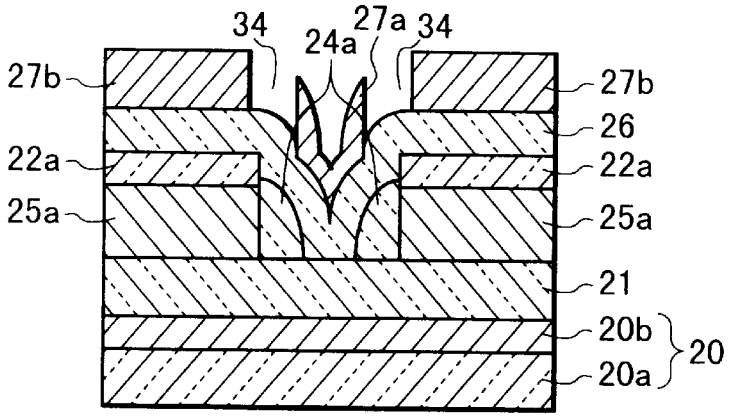

Next, a resist film (not shown) having a predetermined pattern is formed on the emitter electrode 27 by photolithography. By using the resist film as a mask, RIE is performed to form slit openings 34 on both sides of the emitter electrode 27*a* where it is not used as the cathode, as shown in FIG. 8K. An emitter electrode 27*b* is disposed on both sides of the emitter electrode 27*a* via the slit openings 34. This RIE may be performed by using a magnetron RIE system by using $Cl_2$ as etching gas at a reaction chamber pressure of 125 mTorr.

Figure 8L:
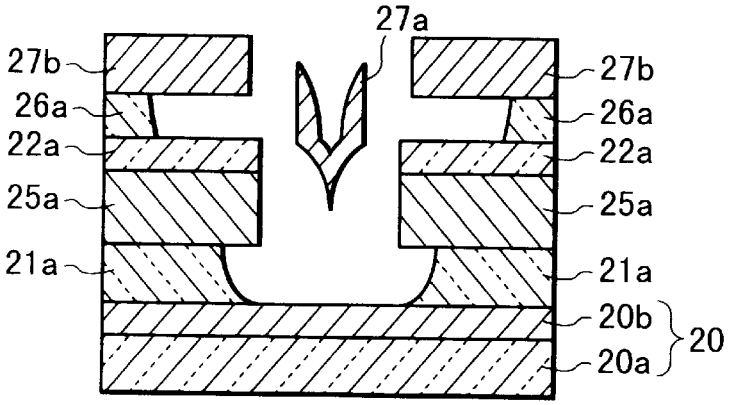

Next, a portion of the fourth sacrificial film 26, the whole of the side spacer 24*a*, and a portion of the first sacrificial film 21 are isotropically etched and removed via the slit openings 34, to thereby leave a peripheral fourth sacrificial film 26*a* and peripheral first sacrificial film 21*a*, as shown in FIG. 8L.

This etching exposes the emitter electrode 27*a*, gate electrode 25*a*, and anode electrode 20*b*. The second sacrificial film 22*a* functions as an antireflection film of the gate electrode 25*a*. It is possible to reduce a variation in the size of gate holes.

Figure 9:
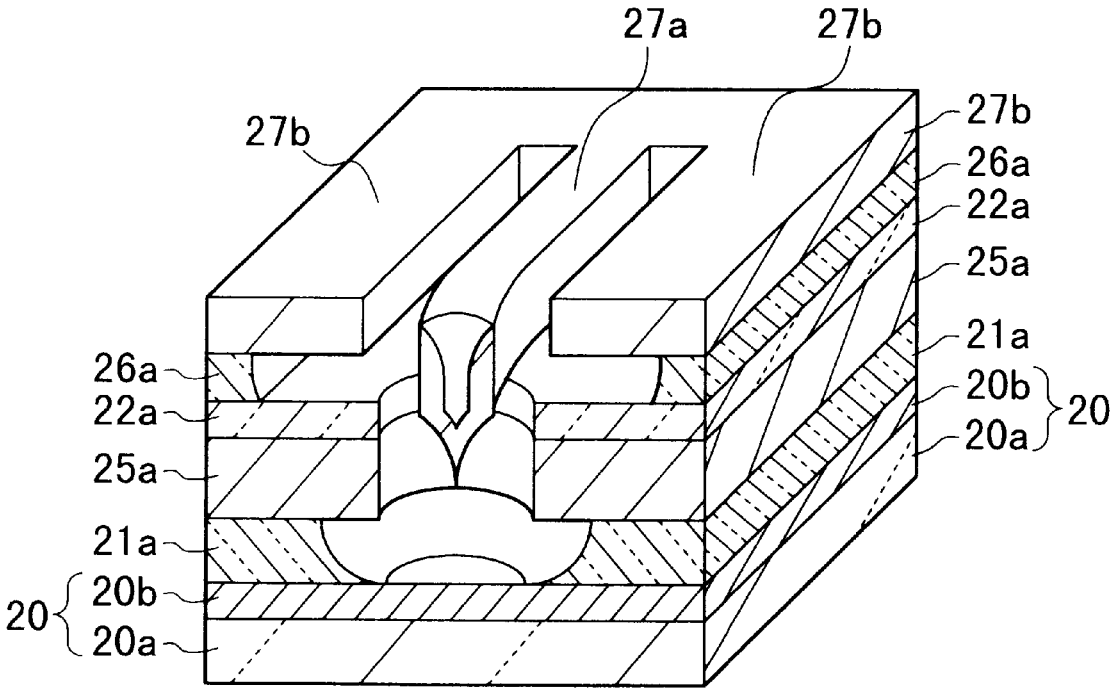
FIG. 9 is a perspective view of the field emission element shown in FIG. 8L.

FIG. 9 is a perspective view of the three-electrode element shown in FIG. 8L. The emitter electrode 27*a* is integrally formed with the emitter electrode 27*b* and is supported by the latter. The gate electrode 25*a* has a circular hole (gate hole) near at the tip of the emitter electrode 27*a*. The tip of the emitter electrode 27*a* has a sharp edge like a needle near at the gate electrode 25*a*.

The three-electrode element has the emitter electrode 27*a* as the cathode and the anode electrode 20*b* as the anode. By applying a positive potential to the gate electrode 25*a*, electrons can be emitted from the emitter electrode 27*a* toward the anode electrode 20*b*.

Even if unnecessary particles are attached to a field emission element during the manufacture processes of the first to seventh embodiments described above, electrical short circuits are hard to be formed. This will be described with reference to FIGS. 10 and 11.

FIG. 10 illustrates an etching process for removing the substrate and the like of the second embodiment shown in FIG. 3C. After the element shown in FIG. 2B is formed, the recess of the emitter electrode 17 is filled with the planarizing film 29*a* made of an SOG film. Thereafter, the planarizing film 29*a* is etched back to planarize the surface of the emitter electrode 17. Then, the support substrate 28 is adhered to the emitter electrode 17 by using the adhesive 29*b* made of, for example, Al. Thereafter, similar to the process shown in FIG. 2C, the element is immersed in etching liquid 32 in order to etch and remove the substrate 10*a* and the like. Even if particles 33 existing in the etching liquid 32 enter through the gate hole 13 the space between the emitter electrode 17 and gate electrode 15, they are caught between the first sacrificial film (insulating film) 12*a* and emitter electrode 17 so that electrical short circuits are not formed. Namely, the first sacrificial film 12*a* made of insulating material faces the emitter electrode at a shortest distance, so that electrical short circuits are hard to be formed between the gate electrode 15*a* and emitter electrode 17. A distance between the emitter electrode 17 and the gate electrode 15*a* or first sacrificial film 12*a* is about 0.5 to 0.05 μm.

Figure 11:
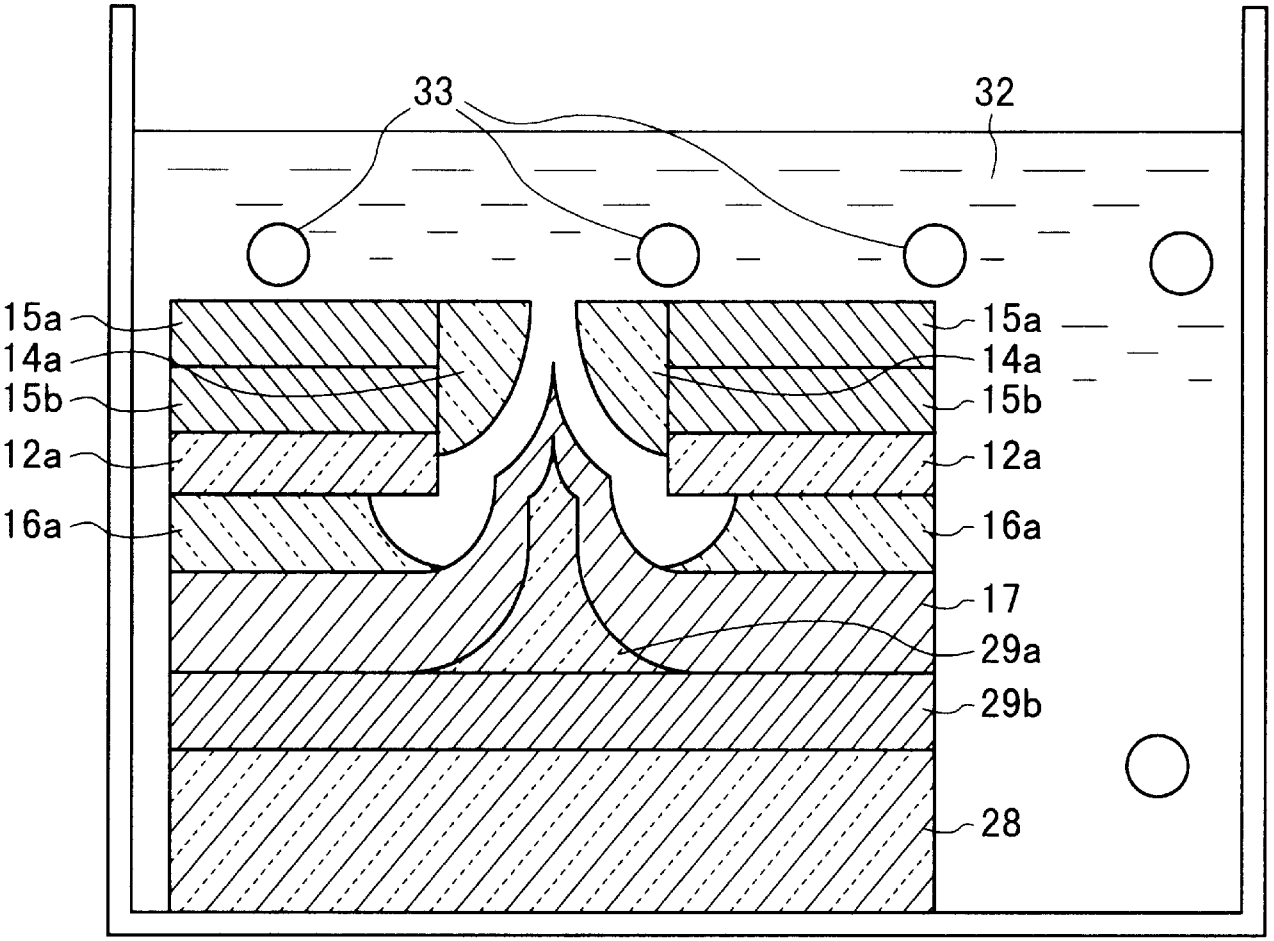
FIG. 11 is a cross sectional view illustrating the etching process to explain the effects of the field emission element manufacture method illustrated in FIG. 3D.

FIG. 11 illustrates the etching process of the second embodiment shown in FIG. 3D. After the support substrate 28 is adhered to the emitter electrode 17 by using the adhesive 29*b*, the substrate 10*a* and the like are etched to leave the side spacer 14*a* as shown in FIG. 3D. In this case, even if there are particles 33 in etching liquid 32 in which the element is immersed, it is difficult for the particles 33 to enter the space between the emitter electrode 17 and gate electrode 15*a* because of a presence of the side spacer 14*a*. Therefore, electrical short circuits are hard to be formed.

The effects described with reference to FIGS. 10 and 11 are not limited only to the embodiments shown in FIGS. 3C and 3D, but similar effects can be realized by all the other embodiments. Similar effects can be realized not only during the etching process but also during a rinsing process, a dry process and the like.

In the embodiments described above, the material of the first and second sacrificial films (insulating films) may be $SiN_x$, $SiO_xN_y$, $SiO_2$, SiO, phosphosilicate glass (PSG), borophosphosilicate glass (BPSG), $TiO_x$, $TaO_x$, $AlO_x$, $HfO_x$, or $AlN_x$. The material of the third sacrificial film (insulating film) may be $SiN_x$, $SiO_xN_Y$, $SiO_2$, PSG, or BPSG.

The insulating film (e.g., insulating film 12*a*) on the gate electrode is not limited to a single layer film, but an insulating film having two or more layers may be formed on the gate electrode.

Figure 12:
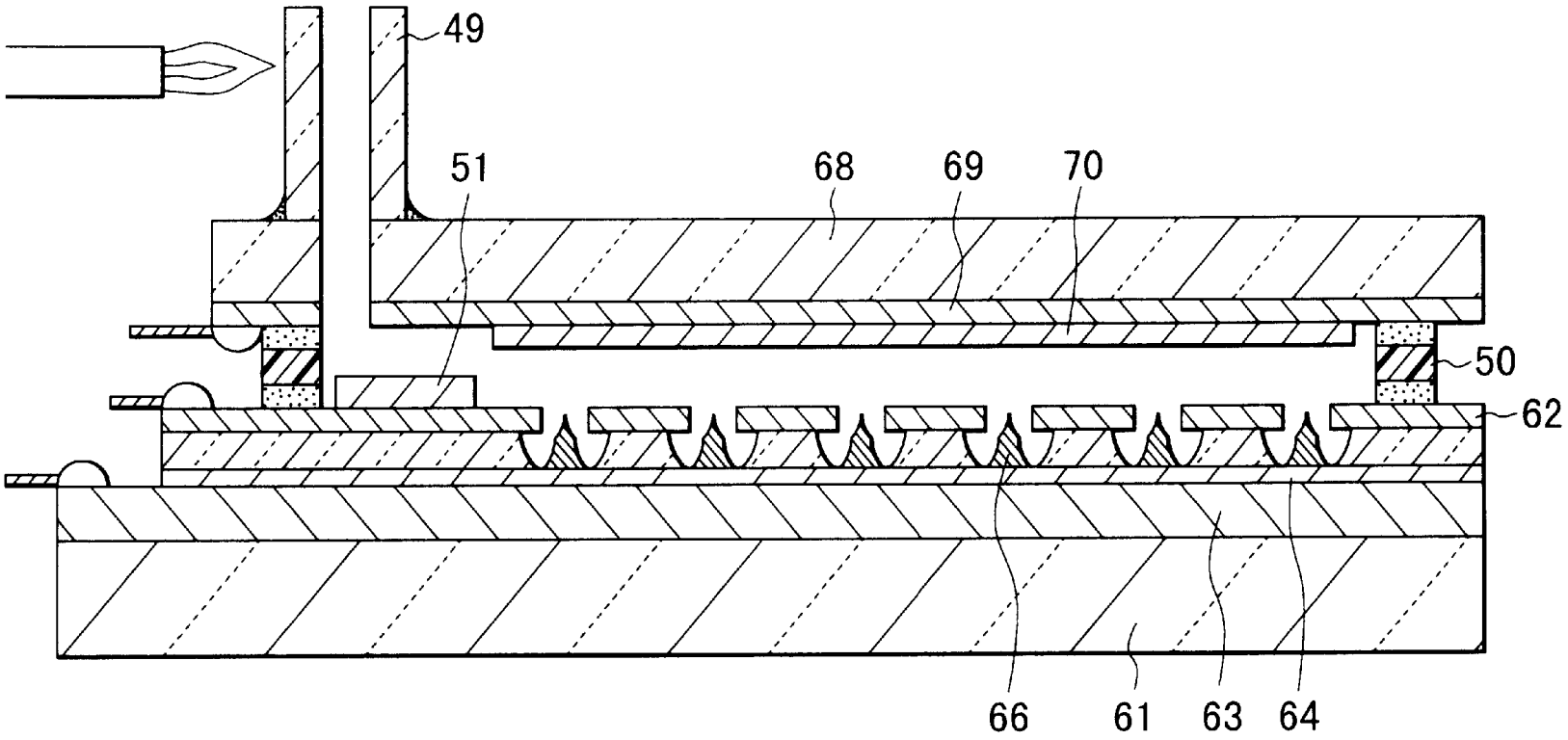
FIG. 12 is a cross sectional view of a flat panel display using field emission elements.

FIG. 12 is a cross sectional view of a flat panel display using field emission elements.

Each field emission element used is a two-electrode element formed, for example, by the manufacture method of the sixth embodiment (FIG. 7C). Formed on a support substrate 61 made of insulating material are a wiring layer 63 made of Al, Cu, or the like and a resistor layer 64 made of polysilicon or the like. On the resistor layer 64, a number of emitter electrodes 66 having a small apex angle and a small radius of curvature of the emitter tip are disposed to form a field emitter array (FEA). Each gate electrode 62 has an opening (gate hole) near at the tip of each emitter electrode 66 and although not shown a voltage can be applied independently to each gate electrode. A plurality of emitter electrodes 66 can also be independently applied with a voltage.

Facing an electron source including the emitter electrode 66 and gate electrode 62, an opposing substrate is disposed including a transparent substrate 68 made of glass, quartz, or the like. The opposing substrate has a transparent electrode (anode electrode) 69 made of ITO or the like disposed under the transparent substrate 68 and a fluorescent member 70 disposed under the transparent electrode 69.

The electron source and opposing substrate are joined together via a spacer 50 made of a glass substrate and coated with adhesive, with the distance between the transparent electrode 69 and emitter electrode 66 being maintained about 0.1 to 5 mm. The adhesive may be low melting point glass.

Instead of the spacer 50 of a glass substrate, a spacer 50 made of adhesive such as epoxy resin with glass beads being dispersed therein may be used.

A getter member 51 is made of Ti, Al, Mg, or the like and prevents emitted gas from attaching again to the surface of the emitter electrode 66.

An air exhaust pipe 49 is coupled to the opposing substrate. By using this air exhaust pipe 49, the inside of the flat display panel is evacuated to about $10_{-5}$ to $10_{-9}$ Torr, and then the air exhaust pipe 49 is sealed by using a burner or the like. Thereafter, the anode electrode (transparent electrode) 69, emitter electrode 66, and gate electrode 62 are wired to complete the flat panel display.

The anode electrode (transparent electrode) 69 is always maintained at a positive potential. Display pixels are two-dimensionally selected by emitter wiring and gate wiring. Namely, a field emission element disposed at a cross point between the emitter wiring and gate wiring applied with voltages is selected.

Negative and positive potentials are applied to the emitter electrode and gate electrodes, and electrons are emitted from the emitter electrode toward the anode electrode. When electrons are bombard with the fluorescent member 70, the bombard area (pixel) emits light.

The material of the gate electrode, second laminated film, and emitter electrode may be semiconductor such as polysilicon and amorphous silicon, silicide compound such as $WSi_x$, $TiSi_x$, and $MoSi_x$, or metal such as Al, Cu, W, Mo, Ni and TiNx.

The present invention has been described in connection with the preferred embodiments. The invention is not limited only to the above embodiments. It is apparent that various modifications, improvements, combinations, and the like can be made by those skilled in the art.

What is claimed is:

1. A method of manufacturing a field emission element comprising the steps of:

(a) forming a conductive gate electrode film on a surface of a substrate, the gate electrode film being made of at least one layer;

(b) forming an insulating film on the gate electrode film;

(c) forming a resist pattern on the insulating film through photolithograpy;

(d) forming a hole through the insulating film through etching by using the resist pattern as a mask;

(e) forming a hole in the gate electrode through etching by using the resist pattern and/or the insulating film as a mask;

(f) removing the resist pattern before or after said step (e);

(g) forming a first sacrificial film covering the insulating film and the substrate;

(h) anisotropically etching back the first sacrificial film to leave a side spacer on a side wall of the hole of the gate electrode and/or on a side wall of the hole of the insulating film, the side spacer being made of a portion of the first sacrificial film;

(i) forming a second sacrificial film covering the insulating film, the gate electrode, the side spacer, and the substrate;

(j) forming a conductive emitter electrode on the second sacrificial film; and (k) removing a portion of the second sacrificial film to expose at least a portion of the emitter electrode film and a portion of the gate electrode film.

2. A method of manufacturing a field emission element according to claim 1, wherein the second sacrificial film is made of insulating material.

3. A method of manufacturing a field emission element according to claim 1, wherein the first sacrificial film is made of insulating material.

4. A method of manufacturing a field emission element according to claim 1, wherein the first and second sacrificial films are made of insulating material.

5. A method of manufacturing a field emission element according to claim 1, wherein the insulating film is made of $SiN_x$ or $SiO_xN_y$.

6. A method of manufacturing a field emission element according to claim 5, wherein the first sacrificial film is made of $SiN_x$ or $SiO_xN_y$.

7. A method of manufacturing a field emission element according to claim 6, wherein the second sacrificial film is made of $SiO_2$, PSG, or BPSG.

8. A method of manufacturing a field emission element according to claim 1, wherein said step (a) includes a step of forming an etching stopper film under the gate electrode film, and said step (e) etches the gate electrode film faster than etching the etching stop film.

9. A method of manufacturing a field emission element according to claim 1, further comprising a step (l) of filling a recess on a surface of the emitter electrode film with conductive material after said step (j).

10. A method of manufacturing a field emission element according to claim 9, further comprising a step (m) of forming a resistor film on the emitter electrode film after said step (l).

11. A method of manufacturing a field emission element according to claim 10, further comprising a step (n) of forming an emitter wiring layer on the resistor film after said step (m).

12. A method of manufacturing a field emission element according to claim 1, wherein said step (a) forms the gate electrode film made of two layers.

13. A method of manufacturing a field emission element according to claim 1, further comprising a step (l) of bonding a support substrate on the emitter electrode film in order to reinforce the emitter electrode film.

14. A method of manufacturing a field emission element according to claim 1, wherein said step (k) is an etching step for removing the portion of the second sacrificial film and leaving the side spacer, the side spacer being made of insulating material.

15. A method of manufacturing a field emission element according to claim 1, wherein the gate electrode film is made of gettering material having a gettering function.

16. A method of manufacturing a field emission element according to claim 15, wherein the gettering material is Ti.

17. A method of manufacturing a field emission element according to claim 1, wherein said step (h) etches the first sacrificial film and the substrate under the first sacrificial film and forms a recess in the substrate.

18. A method of manufacturing a field emission element according to claim 1, wherein said step (a) is a step of forming an anode electrode film on the surface of the substrate, forming an anode insulating film on the anode electrode film, and forming the gate electrode film on the anode insulating film, and said step (k) includes a step of removing a portion of the anode insulating film to expose a surface of the anode electrode.

19. A method of manufacturing a field emission element according to claim 18, further comprising a step (l) of forming a hole in the emitter electrode film after said step (j), and said step (k) etches and removes portions of the second sacrificial film and the anode insulating film via the hole of the emitter electrode film.

20. A method of manufacturing a field emission element according to claim 1, wherein said step (k) includes a step of removing the substrate to expose a lower surface of the gate electrode film.

* * * * *